US006677112B2

(12) United States Patent
Murakami et al.

(10) Patent No.: US 6,677,112 B2
(45) Date of Patent: Jan. 13, 2004

(54) SILVER HALIDE EMULSION, PREPARATION METHOD OF SILVER HALIDE EMULSION, SILVER HALIDE LIGHT-SENSITIVE PHOTOGRAPHIC MATERIAL, SILVER HALIDE LIGHT-SENSITIVE COLOR PHOTOGRAPHIC MATERIAL, AND IMAGE FORMING METHOD

(75) Inventors: Shuji Murakami, Kanagawa (JP); Yuji Tanaka, Kanagawa (JP); Mitsuhiro Kubotera, Kanagawa (JP); Koichiro Kuroda, Tokyo (JP)

(73) Assignee: Konica Corporation (JP)

( * ) Notice: Subject to any disclaimer, the term of this patent is extended or adjusted under 35 U.S.C. 154(b) by 0 days.

(21) Appl. No.: 10/336,700

(22) Filed: Jan. 3, 2003

(65) Prior Publication Data

US 2003/0203328 A1 Oct. 30, 2003

(30) Foreign Application Priority Data

Jan. 11, 2002 (JP) ..... 2002-004686
Feb. 19, 2002 (JP) ..... 2002-041580

(51) Int. Cl.[7] ..... G03C 1/09
(52) U.S. Cl. ..... 430/567

(58) Field of Search ..... 430/567

(56) References Cited

U.S. PATENT DOCUMENTS 5,998,112 A * 12/1999 Yamashita ..... 430/465

* cited by examiner

*Primary Examiner*—Hoa Van Le
(74) *Attorney, Agent, or Firm*—Muserlian, Lucas and Mercanti

(57) ABSTRACT

A silver halide emulsion containing silver halide grains comprising silver chlorobromide grains or silver chloroiodobromide grains, wherein each of silver halide grains has a silver chloride content of not less than 98% and comprises a silver bromide-containing layer having a silver bromide content of 0.5 to 5%, and the silver bromide-containing layer is located at a depth of 0 to 0.01 $\mu$m from the surface of the grain. A silver halide emulsion comprising silver halide grains containing Compound A having adsorptivity to silver, wherein each of the silver halide grains has a silver chloride content of not less than 90% has a core-shell structure comprised of a core and shell having different contents of Compound A each other, and the content of Compound A in the shell is smaller than the content of Compound A in the core.

4 Claims, No Drawings

SILVER HALIDE EMULSION, PREPARATION METHOD OF SILVER HALIDE EMULSION, SILVER HALIDE LIGHT-SENSITIVE PHOTOGRAPHIC MATERIAL, SILVER HALIDE LIGHT-SENSITIVE COLOR PHOTOGRAPHIC MATERIAL, AND IMAGE FORMING METHOD

TECHNICAL FIELD

The present invention relates to a silver halide emulsion, a production method thereof, a silver halide light-sensitive photographic material and a silver halide light-sensitive color photographic material comprising the silver halide emulsion, and an image forming method utilizing them. Particularly, the present invention relates to a silver halide emulsion, which exhibits excellent development stability and excellent latent image stability at high intensity exposure, as well as excellent fine line reproduction stability, a silver halide emulsion, which exhibits high sensitivity as well as low fog at digital exposure which is performed for a short time at high irradiance, and exhibits excellent image stability during the period from completion of the exposure to the start of photographic processing, a production method thereof, a silver halide light-sensitive photographic material and a silver halide light-sensitive color photographic material comprising the silver halide emulsion, and image forming method utilizing them.

BACKGROUND

In recent years, silver halide color paper has been employed in a variety of places due to proliferation of minilabs. Along with such proliferation, exposures during printing have been carried out under various conditions as well as various circumstances. Further, on the market, problems have occurred in which development stability is degraded due to mixing of silver bleach solution with a color developing solution. Further, in recent years, digital image processing has increasingly progressed and the need has rapidly been increased for image formation by scanning exposure, employing high intensity light sources such as light emitting diodes and semiconductor lasers. As a result, an increase in suitability for high intensity and short time exposure is highly demanded for silver halide light-sensitive color photographic materials (hereinafter occasionally referred simply to as light-sensitive materials) employed as an image forming means. Specifically, it has been found that high intensity exposure results in increased susceptibility to effects due to processing solutions and increased degradation of latent image stability.

Namely, increasingly demanded are development of light-sensitive materials which result in excellent images based on conventional photographic image formation, as well as image formation employing quick scanning under high intensity light exposure.

At the same time, the progress of silver halide light-sensitive materials, which are advantageous for image quality, cost, and mass productivity, has been greatly sought in order to compete with the rapid progress of other non-silver salt output media such as ink jet printing systems.

Conventionally, as a means to achieve a quick development process, silver chloride emulsions or silver halide emulsions, having a high silver chloride content, have been employed.

On the other hand, Japanese Patent Application Open to Public Inspection No. 64-26837 discloses an emulsion having a high silver chloride content which has a portion of a high content of silver bromide near the apex of silver halide grains. Further, Japanese Patent Application Open to Public Inspection No. 1-105940 discloses that it is possible to provide an emulsion, having a high silver chloride content, in which silver bromide is subjected to localized Ir doping so as to achieve excellent latent image stability as well as to minimize failure of the reciprocity law. Still further, U.S. Pat. No. 5,627,020 discloses a method of forming the localized portions of silver bromide employing fine Ir doped silver bromide grains. However, none of the methods result in sufficient improvement in initial latent image stability after exposure. Further, Japanese Patent Application Open to Public Inspection No. 11-109534 describes a silver halide emulsion in which a phase having a higher silver bromide proportion, which comprises iridium compounds is located near the surface of silver halide grains and a region in which the concentration of iridium compounds is higher than the outside of said phase having a higher silver bromide proportion is prepared in the inside of said phase having a higher silver bromide proportion, so that failure of the reciprocity law as well as high humidity dependence is minimized and latent image stability is enhanced. These inventions are characterized in that a localized phase containing a high proportion of silver bromide, such as 10 to 40 percent, is provided at the apex portion of silver halide grains. However, the resulting stability of silver halide emulsions as well as the resulting processing stability are insufficient.

Still further, Japanese Patent Application Open to Public Inspection No. 2001-188311 discloses a method in which a phase having a higher proportion of silver bromide as well as silver iodide is provided and the introduction of said higher proportion phase is carried out twice independently, that is, prior to the addition of antifoggants and after the same so that the resulting failure of the reciprocity law is minimized and the resulting coating composition stability is enhanced. However, the stability of the resulting silver halide emulsion is insufficient.

Widely known as examples regarding doping of cyano ligand containing complexes are European Pat. Nos. 336,425 and 336,426; Japanese Patent Application Open to Public Inspection Nos. 2-20853, 2-20854, and 5-66511; U.S. Pat. Nos. 5,132,203, 4,847,191, and 3,790,300; and Japanese Patent Publication No. 48-35373. These patents exhibit an increase in sensitivity as well as minimization of failure of the reciprocity law, however drawbacks with latent image stability as well as minimization of fogging during photographic processing are not completely overcome. Further, Japanese Patent Application Open to Public Inspection Nos. 11-24194, 11-102042, 10-293377, 8-179452, and 7-72569 and U.S. Pat. Nos. 5,360,712, 5,457,021, and 5,462,849 describe an increase in sensitivity employing organic ligand complexes, comprising imidazole as a ligand. However, improvements are demanded due to insufficient development stability as well as insufficient latent image stability under high intensity exposure.

Further, it has been proved that in digital exposure systems which have recently received much attention, conventional techniques to improve latent image stability are not capable of resulting in commercially viable quality in the adaptability for high intensity exposure over a short time. Listed as techniques applied to such a digital exposure system are, for example, a chemical sensitization and spectral sensitization method suitable for formation of the localized silver bromide phase described in U.S. Pat. No. 5,601,513 and further methods employing iodochloride emulsions described in European Pat. Nos. 750,222 and 772,079.

However, according to investigations performed by the inventors of the present invention, it has been proved that when adaptability for digital exposure is improved employing the aforesaid techniques, latent image stability is not sufficiently enhanced, and in addition, pressure resistance as well as stability for temperature variation during exposure are markedly degraded. As a result, at present, development of improving technology is urgently demanded.

SUMMARY OF THE INVENTION

An aspect of the present invention is to provide a silver halide emulsion, which exhibits excellent development stability and excellent latent image stability at high intensity exposure, as well as excellent fine line reproduction stability. An other aspect of the present invention is to provide a silver halide emulsion, which exhibits high sensitivity as well as low fog at digital exposure which is performed for a short time at high irradiance, and exhibits excellent image stability during the period from completion of the exposure to the start of photographic processing. Still other aspect of the present invention is to provide a production method of the silver halide emulsion, a silver halide light-sensitive photographic material and a silver halide light-sensitive color photographic material comprising the silver halide emulsion, an d an image forming method utilizing them.

The aspects of the present invention were achieved employing the embodiments described below.

Structure 1

A silver halide emulsion contains silver chlorobromide grains or silver chloroiodobromide grains. Each of the silver halide grains has a silver chloride content of not less than 98% and comprises a silver bromide-containing layer having a silver bromide content of 0.5 to 5%, and the silver bromide-containing layer is located at a depth of 0 to 0.01 $\mu$m from the surface of the grain.

Structure 2

A silver halide emulsion comprising silver halide grains containing Compound A having adsorptivity to silver. Each of the silver halide grains has a silver chloride content of not less than 90% and has a core-shell structure comprised of a core and shell having different contents of Compound A each other, and the content of Compound A in the shell is smaller than the content of Compound A in the core.

Structure 3

A silver halide emulsion comprising a silver halide grains, each of the silver halide grains having a silver chloride content of not less than 90%, prepared by being conducted a chemical sensitization, wherein when the chemical sensitization is conducted, the Compound B having polychalcogen structure represented by the following General Formula (I), and a Mercapto Compound C are added in this order into a vessel, in which the chemical sensitization is conducted, $$—(X)_m—(Y)_n— \qquad \text{General Formula (I)}$$

wherein each of X and Y represents an atom selected from sulfur, selenium and tellurium; each of m and n represents an integer of not less than 1.

Structure 4

An preparation method of a silver halide emulsion comprising silver halide grains comprising silver chlorobromide grains or silver chloroiodobromide grains. Each of the silver halide grains has a silver halide content of not less than 98%. The preparation method comprising the steps in the following order of: a host grain emulsion preparation step to prepare a host grain emulsion; a first bromide addition step to add a bromide compound to the host grain emulsion; a chemical sensitization step to subjecting a chemical sensitization to the host grain emulsion for at least 60 minutes after the first bromide addition step; and a second bromide addition step to add a bromide compound to the host grain emulsion after the chemical sensitization step.

Structure 5

A preparation method of a silver halide emulsion comprising silver halide grains, each of the silver halide grains having a silver chloride content of not less than 90%, the method comprising the steps in the following order of: preparing a host grain emulsion; adding a chemical sensitizer to the host grain emulsion; adding the Compound B having polychalcogen structure represented by the following General Formula (I); and adding the Mercapto Compound C.

Structure 6

A silver halide light-sensitive photographic material comprising a support provided thereon at least an image forming layer comprising the silver halide emulsion of the present invention.

Structure 7

A silver halide light-sensitive color photographic material comprising a support and provided thereon at least a yellow image forming layer, a magenta image forming layer and a cyan image forming layer, wherein at least one of the image forming layers comprises a silver halide emulsion of the present invention.

Structure 8

An image forming method comprising the steps of: exposing the silver halide light-sensitive color photographic material of claim 21 in an exposure time of $10^{-10}$ to $10^{-3}$ second per pixel; and subjecting the silver halide light-sensitive color photographic material to color developing to obtain color images for the respective image forming layers, wherein the effective gradation range (VE) of each of the obtained color image is 0.65 to 0.84; and the difference ($\Delta$VE) between the VE value of the color image forming layer in which effective gradation range (VE) is maximized and the VE value of the color image forming layer in which effective gradation value (VE) is minimized is from 0 to 0.08.

DETAILED DESCRIPTION OF THE INVENTION

The present invention will now be detailed.

In the present invention, it is preferable that in a silver halide emulsion comprising silver chlorobromide grains or silver chloroiodobromide grains having a silver chloride content of not less than 98 percent, each of the silver chlorobromide grains or silver chloroiodobromide grains has a layer having a silver bromide content of 0.5 to 5.0 percent, and the layer is located at a depth of 0 to 0.01 $\mu$m from the surface of the silver halide grain. It is possible to form the silver bromide containing layer in the silver halide grain by adding fine silver halide grains having a silver bromide content of 0.5 to 5.0 percent, which have a smaller grain diameter than the host grain, namely preferably at most 0.1 $\mu$m and more preferably at most 0.07 $\mu$m. Further, it is preferable to adjust to 0.5 to 5.0 percent the silver bromide content of an aqueous halide solution which is added employing a double jet precipitation method known in the art in this industry. The silver bromide content of the finalized silver halide emulsion is preferably from 0.1 to 0.5 mol percent with respect to the total silver amount.

It was discovered that by uniformly providing the silver bromide-containing layer, having a silver bromide content of 0.5 to 5.0 percent, constituted as above, from grain surface to grain subsurface, it was possible to achieve compatibility between the processing stability and the latent image stability, and also to achieve excellent emulsion stability. It is preferable that said silver bromide containing layer has a silver bromide content of 2 to 4 percent.

Further, in the present invention, it preferable that in the silver halide emulsion comprising the silver chlorobromide grains or silver chloroiodobromide grains having a silver chloride content of at least 98 percent, each of the silver chlorobromide grains or silver chloroiodobromide grains has a region containing a complex having a cyano ligand at the position having a depth of 0.001 to 0.010 $\mu$m from the silver halide grain surface, and has a region containing neither a complex having cyano ligand nor a complex having carbon atom at the position nearer the grain surface than the region containing the complex having the cyano ligand.

The complex having the cyano ligand according to the present invention are not particularly limited, as long as the complexes are coordinated with at least one cyano ligand. The complexes are preferred in which at least four cyano ligands are coordinated with iron, tellurium, and osmium. Specific examples of the complexes having cyano ligand usable in the present invention are shown below. However, the present invention is not limited to these examples.

A1: $K_4Fe(CN)_6$

A2: $K_4Ru(CN)_6$

A3: $K_4Os(CN)_6$

In the present invention, it is preferable that in a silver halide emulsion comprising the silver chlorobromide grains or silver chloroiodobromide grains having a silver chloride content of at least 98 percent, each of the silver chlorobromide grains or silver chloroiodobromide grains has a region containing a complex having a carbon atom in the position at a depth of 0.001 to 0.010 $\mu$m from the silver halide grain surface, and has a region containing neither a complex having a carbon atom nor a complex having cyano ligand at the position nearer the grain surface than the complex having a carbon atom.

The complex having a carbon atom according to the present invention refer to complexes, which are coordinated with at least one ligand having at least one carbon atom. The specific examples of compounds are shown below. However, the present invention is not limited to these examples.

B1: $[Ru(byp)_2(S—NH_3\text{-phen})]^{2+}$

B2: $Ru(\text{acetylacetonate})_3$

B3: $[(NH_3)_5Ru—NC—C_6H_4—Cn—Ru\ (NH_3)_5](PF_6)_4$

B4: $[RuCl_2(byp)_2]$

Incidentally, abbreviations employed in the above compounds are as follows:

byp: bipyridine phen: phenanthroline

In order to incorporate each complex compound of the present invention into the silver halide grain in the emulsion, the each complex may be added during the process prior to formation of silver halide grains, the silver halide grain forming process, or the physical ripening process after formation of silver halide grains, so that the constitution according to the present invention is achieved. In order to prepare silver halide emulsions which satisfy grain constituting conditions specified in the present invention, it is preferable that the complex compounds according to the present invention are dissolved with silver halides and are added during the grain forming process.

The added amount of the complex compounds of the present invention to silver halide grains is preferably from $1\times10^{-9}$ to $1\times10^{-2}$ mol per mol of silver halide, and is most preferably from $1\times10^{-8}$ to $5\times10^{-5}$ mol.

In order to prepare the silver halide emulsion of the present invention, heavy metal ions may further be incorporated in the interior of the grain. Listed as usable heavy metal ions may be each ion of Groups 8 through 10 metals such as iron, iridium, platinum, palladium, nickel, rhodium, osmium, ruthenium, and cobalt; Group 12 transition metals such as cadmium, zinc, and mercury; and others such as lead, rhenium, molybdenum, tungsten, gallium, and chromium. Further, complexes exhibiting desensitization, comprising a halogen ion, nitrosyl, or thionitrosyl incorporated in a ligand, may be employed in combination.

In the present invention, it is preferable that in a silver halide emulsion comprising silver chlorobromide grains or silver chloroiodobromide grains having a silver chloride content of at least 98 percent, during the grain preparation, a brominated compound is added at least twice and between the two addition steps, chemical sensitization is carried out for more than or equal to 60 minutes. It was discovered that by setting conditions as specified in the present invention, it was possible to achieve compatibility between the processing stability and the latent image stability, as well as to achieve the excellent emulsion stability.

The brominated compounds according to the present invention are not particularly limited, as long as they are bromides. They are preferably water-soluble compounds. For example, KBr, NaBr, AgBrCl, and AgBr are listed. These compounds are independently added at least twice. The interval of the two adding step is preferably after addition of sensitizer and before reaching the optimal point of chemical sensitization. During the interval, the chemical sensitization is carried out preferably for no less than 60 minutes and more preferably for no less than 120 minutes. Further, it is more preferable that in the presence of antifoggants, the first bromide addition is carried out. Further, it is preferable that antifoggants be added after the second bromide addition. Still further, it is preferable that antifoggants not be added during the second bromide addition.

Further, as a result of diligent investigations of the inventors of the present invention, it was discovered that one of the aspects of the present invention were achieved by employing chalcogen compounds and mercapto compounds during production of silver halide emulsions and optimizing the duration of addition time of each compound. Conventionally, during production of silver halide emulsions, chalcogen compounds and mercapto compounds have been widely employed as a sensitizer, an antifoggant and a development retarder. However, being based on conventional techniques, it is extremely difficult to assume that the embodiments of the present invention, in which the addition method as well as the added amount is taken into account, have achieved the aspect of the present invention. The results of the present invention are unexpected.

The silver halide emulsion of the present invention preferably has the following structures from the viewpoint of achieving the aspect of the present invention.

Namely, in the present invention, it is preferable that the silver halide emulsion has a silver chloride content of at least 90 percent, and the silver halide emulsion contains Compound A having adsorptivity to silver. Further, each of the silver halide grains of the silver halide emulsion has a core-shell structure comprising at least two regions having different concentration of said Compound A, and the concentration of said Compound A contained in the phase nearest the surface (hereinafter referred to as the shell region) is lower than the concentration of said Compound A contained in the deeper region from the surface (hereinafter referred to as the core region). It is particularly preferable that the average concentration of Compound A contained in the shell region is less than $1.5\times10^{-4}$ mol per mol of silver halide.

Further, as another embodiment, it is preferable that the silver halide emulsion has a silver chloride content of at least 90 percent, and the silver halide emulsion is prepared by subjected to a chemical sensitization, and when the chemical sensitization is conducted, the Compound B having polychalcogen structure represented by the following General Formula (I), and a Mercapto Compound C are added in this order into a vessel, in which the chemical sensitization is conducted. This like silver halide emulsion can be prepared by adding Compound B having the structure represented by aforesaid General Formula (I) and Mercapto Compound C in the stated order during chemical sensitization process of said silver halide emulsion.

Specifically, in the production method, it is preferable that in the chemical sensitization, the Compound B is added 120 minutes after the addition of a chemical sensitizer, and the Mercapto Compound C is added later than that. Further, it is preferable that the interval between addition of Compound B and addition of Mercapto Compound C is from 10 seconds to 30 minutes. Still further, it is particularly preferable that Compound B has a sulfur containing ring structure.

By employing these production methods, it is possible to prepare silver halide emulsions, especially when subjected to digital exposure, which exhibit higher sensitivity, lower fogging, excellent latent image stability, and enhanced pressure resistance.

The composition of silver halide emulsions other than those described above and the composition elements of silver halide light-sensitive color photographic materials will now be detailed.

The silver halide emulsion according to the present invention (hereinafter referred to as the emulsion of the present invention) is characterized to be a so-called high silver chloride emulsion having a high silver chloride content. A high silver chloride emulsion, which is comprised of silver chloride in an amount of at least 90 mol percent, is preferred. In such a case, the emulsion may have optimal compositions such as silver chloride, silver chlorobromide, silver chloroiodobromide, and silver chloroiodide. However, silver chlorobromide and silver chloroiodide comprising silver chloride in an amount of 97 mol percent are specifically preferred. From the viewpoint of quick processing characteristics as well as processing stability, a silver halide emulsion comprising silver chloride in an amount of no less than 98 mol percent is more preferred and 98.0 to 99.9 mol percent is still more preferred.

In the present invention, it is preferable that the silver halide grains of the silver halide emulsion are formed in the presence of Compound A having adsorptivity to silver. The Compound A having adsorptivity to silver in the present invention, refers to compounds capable of forming salts with silver ions, which exhibit the desired low solubility. The solubility product of silver salts is commonly represented by a pKsp value. Compound A of the present invention refers to that the salt of Compound A and silver ion has pKsp value of 10 to 18. Specifically listed as compounds which exhibit such a value are compounds having a mercapto group and nitrogen containing heterocyclic compounds such as tetraazaindenes, tetrazoles, benzimidazoles, benzotriazoles, and imidazoles. Of these, compounds having a mercapto group are p referred and compounds having a mercaptotetrazole structure are more preferred.

Listed as examples of preferred Compound A which can be used to achieve this purpose may be compounds represented by following General Formula (II) described in the lower column on page 7 of Japanese Patent Application Open to Public Inspection No. 2-146036.

General Formula (II)

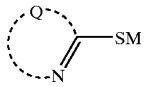

Listed as specific examples of more preferred Compound A may be following compounds (IIa-1) through (IIa-8) and (IIb-1) through (IIb-7) described on page 8 of the aforesaid patent publication.

II a-1

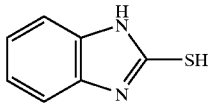

II a-2

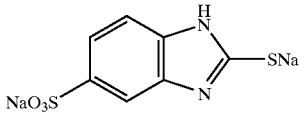

II a-3

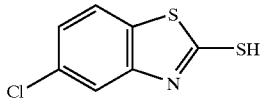

II a-4

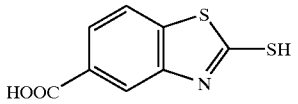

II a-5

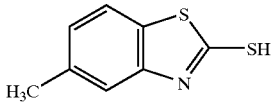

II a-6

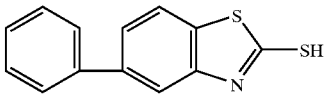

II a-7

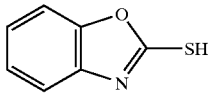

II a-8

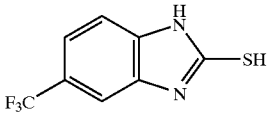

-continued

II b-1

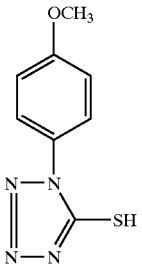

II b-2

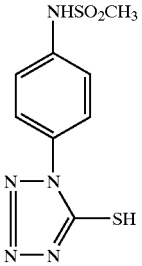

II b-3

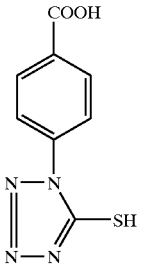

II b-4

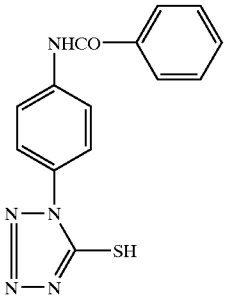

II b-5

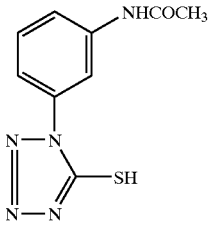

II b-6

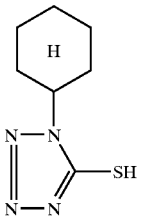

-continued

II b-7

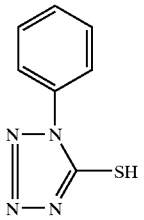

Further, compounds such as 1-(3-methoxyphenyl)-5-mercaptotetrazole and 1-(4-ethoxyphenyl)-5-mercaptotetrazole can be cited as preferable examples of Compound A. However, the present invention is not limited to these examples.

The silver halide grain in the emulsion of the present invention preferably comprises at least two regions in which the concentration of aforesaid Compound A is different from each other. It is more preferable that the concentration of Compound A contained in a surface region (a shell region) is less than the concentration of Compound A contained in the interior region (the core region). The shell region, as described herein, refers to the final region during grain formation through grain growth and the exterior region of the grain including the grain surface. In the present invention, the entire region of the grain interior from this shell region is defined as the core region. The number of the region in which the concentration of Compound A is different is not particularly limited. Further, the concentration of Compound A is also not limited as long as desired grains are formed. However, in the present invention, it is preferable that the concentration of Compound A in the shell portion is less than the concentration of Compound A in the core portion.

Further, the average concentration of Compound A in the shell region of the silver halide grain of the present invention is preferably less than $1.5\times10^{-4}$ mol per mol of silver halide. The concentration of Compound A incorporated in the shell may be 0, is preferably from 0.1 to $1\times10^{-4}$ mol per mol of silver halide, and is more preferably from 0.1 to $0.5\times10^{-4}$ mol.

The concentration of Compound A contained in the core region is not limited as long as it is greater than that in the shell region, but is preferably from 0.5 to $3\times10^{-4}$ mol.

Further, a plurality of compounds may be added in combination, as long as the compounds correspond to Compound A, and types of the compounds as well as combinations of the compounds in the core region may be different from those in the shell region. As long as the total amount of added compounds satisfies the conditions specified in the present invention, the effects of the present invention will be sufficiently exhibited. These compounds may be incorporated in the system, in which grains are formed, employing any method. However, it is preferable that these compounds are previously incorporated in a halide solution and subsequently added.

In the production method of the silver halide emulsion of the present invention, the volume of the shell region is preferably within 50 percent of the total volume of silver halide grains, and is more preferably within 30 percent. Further, it is preferable to apply the present invention to the embodiments in which a sub-surface region near the surface, which is extremely shallow, is employed as a shell region.

The silver halide grains in the silver halide emulsion of the present invention preferably comprises Compound B having the polychalcogen structure represented by aforesaid General Formula (I) in the core region, and Mercapto Compound C in the shell region.

In aforesaid General Formula (I), X and Y each represents an atom selected from sulfur, selenium, or tellurium, and m and n each represents an integer of 1 or more. Atoms X and Y may be linked by a single bond or an unsaturated bond.

Compounds which comprise the aforesaid structure are included in Compound B according to the present invention. However, compounds, having a polysulfide structure are preferred in which both X and Y represent a sulfur. One of such preferred compounds is a disulfide compound.

Further, more preferred Compound B includes compounds having such a structure that the aforesaid polysulfide structure is included in a ring structure. Listed as one of the most preferred compounds is elemental sulfur.

Specific compounds represented by Compound B usable in the present invention will now be exemplified. However, the present invention is not limited to these examples. Further, as long as compounds correspond to Compound B, these may be employed in combinations of a plurality of them.

BB-1

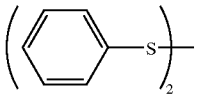

BB-2

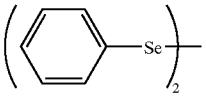

BB-3

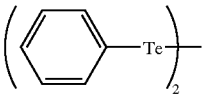

BB-4

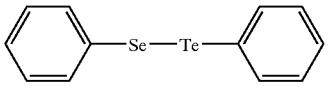

BB-5

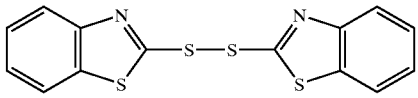

BB-6

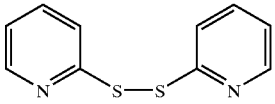

BB-7

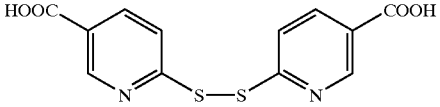

BB-8

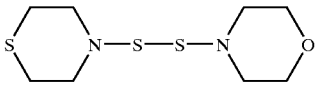

BB-9

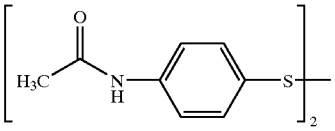

-continued

BB-10

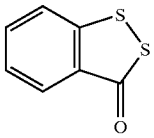

BB-11

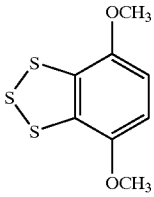

BB-12

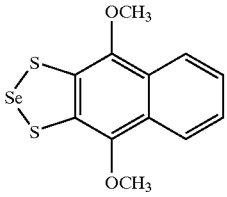

BB-13

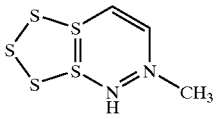

BB-14

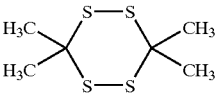

BB-15

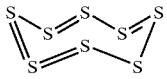

Mercapto Compound C according to the present invention corresponds to representative compounds which are generally employed as an antifoggant. Listed as examples of preferred compounds usable for this purpose may be the compounds represented by General Formula (II) described above. Listed as more preferred compounds may be compounds (IIa-1) through (IIa-8) and (IIb-1) through (IIb-7) described above, and 1-(3-methoxyphenyl)-5-mercaptotetrazole and 1-(4-ethoxyphenyl)-5-mercaptotetrazole. However, the present invention is not limited to these examples.

In the production method of the silver halide emulsion of the present invention, it is preferable that during chemical sensitization process, the aforesaid Compound B is added and subsequently, the aforesaid Mercapto Compound C is added. When each of the aforesaid compounds is simultaneously added, the aforesaid compounds are previously mixed and then added, or Compound B is added after adding Mercapto Compound C, it is difficult to exhibit the effects of the present invention.

Each of the aforesaid Compounds B and C according to the present invention may be added at any time during the chemical sensitization process of silver halide emulsions. However, it is preferable that addition is carried out at the stage in which the chemical sensitization has progressed sufficiently. Specifically, it is preferable that the aforesaid compounds are added 120 minutes after the addition of chemical sensitizers. Further, it is preferable that the interval between addition of Compound B and addition of Mercapto Compound C is from 10 seconds to 30 minutes. Specifically, it is preferable that Mercapto Compound C is added from 5 to 20 minutes after adding Compound B. In such a case, the added amount of Compound B is preferably from $5\times10^{-8}$ to $1\times10^{-6}$ mol per mol of silver halide. Further, the added amount of Mercapto Compound C is preferably from $1\times10^{-5}$ to $5\times10^{-3}$ mol per mol of silver halide.

In the present invention, the image forming method preferably comprises a step of: exposing a silver halide light-sensitive color photographic material in an exposure time of $10^{-10}$ to $10^{-3}$ second per pixel; and subjecting the exposed silver halide light-sensitive color photographic material to color developing. The silver halide light-sensitive color photographic material comprises a support having thereon at least one each of a yellow image forming layer, a magenta image forming layer, and a cyan image forming layer, at least one layer of said color image forming layers comprising the silver halide emulsion of the present invention. Further, it is preferable that the effective gradation range (VE) of a color image obtained by color developing is from 0.65 to 0.84 for each of the color image forming layers, and the difference (ΔVE) between the VE value of the color image forming layer in which effective gradation range (VE) is maximized and the VE value in which effective gradation value (VE) is minimized is from 0 to 0.08.

The effective gradation range (VE), as described in the present invention, is defined as the exposure amount range in which the point-gamma value during output of a gray scale becomes not less than 1.0. The inventors of the present invention performed diligent investigations and discovered that said exposure range resulted in great effects on print image quality during digital exposure, and particularly great effects on reduced bleeding of text images as well as reduced occurrence of scanning exposure streaks.

Incidentally, the point-gamma, as described in the present invention, is defined by the following formula which is described in "The Theory of the Photographic Process", edited by T. H. James, Fourth Edition, page 502, and represents the differential value of an optional point on the characteristic curve (D-LogE curve) comprised of ordinate-density D and abscissa-exposure amount:

$$\text{Point-gamma}=dD/d\text{Log}E$$

wherein D represents the density and E represent the exposure amount.

In the image forming method of the present invention, from the viewpoint of achieving the target effects of the present invention, it is preferable to satisfy necessary conditions specified in the present invention, employing exposure conditions, such as an exposure time of $10^{-10}$ to $10^{-3}$ second per pixel. In order to further clarify the effects of the present invention, it is possible to preferably employ the evaluation methods described below.

Namely, a 1 cm square patch is exposed to a light-sensitive material under variation of the exposure amount, employing a laser scanning exposure apparatus which is adjusted so that overlapping between rasters of the light beam is in the range of 5 to 30 percent. The exposed light-sensitive material is subjected to color development (incidentally, after color development, conventional bleach-fixing and washing or stabilization process are carried out) at 37±0.5° C. for 45 seconds, employing color developing solution (CDC-1), described below. Subsequently, the reflection density of gray patch portions of the resulting sample is determined, and a characteristic curve is drawn in which the abscissa represents the exposure amount (LogE) and the ordinate represents the reflection density (D). At each step, the differential value of density with respect to the exposure amount is calculated, whereby it is possible to determine the point-gamma. Incidentally, time from the completion of exposure to the start of development should be one hour.

(Color Developing Solution (CDC-1))

Pure water 800 ml

Triethylenediamine 2g

Diethylene glycol 10 g

Potassium bromide 0.02 g

Potassium chloride 4.5 g

Potassium sulfite 0.25 g

N-ethyl-N-(βmethanesulfonamidoethyl)-3-methyl-4-aminoaniline sulfate 4.0 g

N,N-diethylhydroxylamine 5.6 g

Triethanolamine 10.0 g

Sodium diethylenetriaminepentaacetato 2.0 g

Potassium carbonate 30 g

Water to make 1 liter

The pH was adjusted to 10.1 by adding sulfuric acid or potassium hydroxide.

In the present invention, the diameter of a light beam (the beam diameter) is identified as raster width. The light beam diameter, as described herein, can be defined as the diameter of a circle which is formed by taking out the point so that the intensity of said light beam becomes $e^{-2}$ times the maximum intensity (the beam center). It is possible to determine the light beam diameter employing, for example, a beam monitor in which a slit and a power merger are combined.

The composition of silver halide emulsions other than those described above and the composition elements of silver halide light-sensitive color photographic materials will now be detailed.

Heavy metal ions are preferably incorporated in the silver halide emulsions of the present invention. Listed as preferably usable heavy metal ions to achieve such objects, may be each ion of Group 8 through 10 metals such as iron, iridium, platinum, palladium, nickel, rhodium, osmium, ruthenium, and cobalt; Group 12 transition metals such as cadmium, zinc, and mercury; and other metals such as lead, rhenium, molybdenum, tungsten, gallium, and chromium. Of these, preferred are metal ions of iron, iridium, platinum, ruthenium, gallium, and osmium. These metal ions may be added to silver halide emulsions in the form of salts and complexes.

When the aforesaid heavy metal ion forms a complex, preferred as ligands or ions are, for example, cyanide ions, thiocyanate ions, cyanate ions, chloride ions, bromide ions, iodide ions, nitrate ions, carbonyl and ammonia. Of these, preferred are cyanide ions, thiocyanate ions, isothiocyanate ions, chloride ions, and bromide ions.

Heavy metal ions may be incorporated in the silver halide emulsion of the present invention as follows. Any of said heavy metal compounds may be added at any time prior to formation of silver halide grains, during formation of silver halide grains, and during physical ripening after formation of silver halide grains. In order to prepare silver halide emulsions which satisfy the aforesaid conditions, it is possible to dissolve heavy metal compounds together with halide salts and continuously add the resulting solution over the entire period of the grain formation process or during a part of the process.

The added amount of the aforesaid metal ions in a silver halide emulsion is preferably from $1\times10^{-9}$ to $1\times10^{-2}$ mol per mol of silver halide, and is more preferably from $1\times10^{-8}$ to $5\times10^{-5}$ mol.

The silver halide emulsion of the present invention may be prepared employing the acid method, the neutral method, or the ammonia method. Further, silver halide grains may be those which are grown without any treatment or which are grown after preparing seed grains. The method to prepare seed grains may be the same as or different from the method to grow full-sized grains.

Further, employed as methods to allow water-soluble silver salts to react with water-soluble halides may be a normal mixing method, a reverse mixing method, a double-jet method, and combinations thereof. Of these, the double-jet method is preferred. Further, employed as one method of the double-jet method may be a pAg controlled double jet method, described in Japanese Patent Publication Open to Public Inspection No. 54-48521.

Still further, employed may be an apparatus, described in Japanese Patent Publication Open to Public Inspection Nos. 57-92523 and 57-92524, in which water-soluble silver salts, as well as water-soluble halides, are supplied from an addition apparatus arranged in a reaction mother composition, an apparatus, described in German OLS Pat. No. 2,921,164, in which an aqueous water-soluble silver salt solution, as well as an aqueous water-soluble halide solution, is added while continuously varying the concentration, and an apparatus, described in Japanese Patent Publication No. 5-6-501776, in which a reaction mother composition is removed from a reaction vessel and grains are formed while maintaining a constant distance among silver halide grains by concentrating said reaction mother composition, employing an ultrafiltration method. Further, if desired, silver halide solvents such as thioether may be used. Still further, compounds such as mercapto group containing compounds, nitrogen containing heterocyclic compounds and compounds such as sensitizing dyes may be added during formation of silver halide grains, or after the completion of grain formation.

In the light-sensitive materials of the present invention, it is possible to employ silver halide grains having any of several optional shapes. One of preferred examples is a cube having a (100) plane as a crystal surface. Further, grains having a shape such as an octahedron, a tetradecahedron, or a dodecahedron are prepared, employing methods described in publications such as U.S. Pat. Nos. 4,183,756 and 4,225,666; Japanese Patent Application Open to Public Inspection No. 55-26589; Japanese Patent Publication No. 55-42737, and Journal of Photographic Science 21, 39 (1973), and employed. Still further, grains having a twin plane may be employed.

In the present invention, it is preferable that at least 50 percent of the total projected area of said silver halide grains in the silver halide emulsion is comprised of planar particles having an aspect ratio of at least 2.

In the light-sensitive materials of the present invention, silver halide grains, which are comprised of a single shape, are preferably employed. However, it is particularly preferable that at least two types of monodispersed silver halide emulsions are added to the same layer.

The diameter of silver halide grains of the present invention is not particularly limited. However, taking into account quick processing properties, sensitivity, and the other desirable photographic performance, the diameter is preferably in the range of 0.1 to 1.2 $\mu$m, and is more preferably in the range of 0.2 to 1.0 $\mu$m. It is possible to determine said diameter, employing the projected area of grains or a diameter approximated value. When grains have a substantially uniform shape, it is possible to express the resulting grain size distribution, employing the diameter or the projected area.

Silver halide grains employed in the light-sensitive materials of the present invention are preferably monodispersed silver halide grains of which grain size distribution has a variation coefficient of preferably at most 0.22 and more preferably at most 0.15. It is particularly preferable that at least two types of monodispersed emulsions, having a variation coefficient of at most 0.15, a re added to the same layer. The variation coefficient, as described herein, refers to a coefficient representing the width of the grain size distribution and is defined by the formula described below:

$$\text{Variation coefficient}=S/R$$

wherein S is the standard deviation of the grain size distribution and R is the average grain diameter.

As used herein, th e grain diameter refers to the diameter when a silver halide grain is spherical, and to the diameter of a circle having the same area as the projected image when a silver grain is cubic or in a shape other than a sphere.

Employed as apparatuses and methods to prepare silver halide emulsions may be any of those known in the art of this industry.

Further, employed may be an apparatus, described in Japanese Patent Publication Open to Public Inspection Nos. 57-92523 and 57-92524, in which water-soluble silver salts, as well as water-soluble halides, are supplied from an addition apparatus arranged in a reaction mother composition, an apparatus, described in German OLS Pat. No. 2,921,164, in which an aqueous water-soluble silver salt solution, as well as an aqueous water-soluble halide solution, is added while continuously varying the concentration, and an apparatus, described in Japanese Patent Publication No. 56-501776, in which a reaction mother composition is removed from a reaction vessel and grains are formed while maintaining a constant distance among silver halide grains by concentrating said reaction mother composition, employing an ultrafiltration method. Further, if desired, silver halide solvents such as thioether may be used. Still further, compounds such as mercapto group-containing compounds, nitrogen-containing heterocyclic compounds and compounds such as sensitizing dyes may be added during formation of silver halide grains, or after the completion of grain formation.

In the present invention, it is preferable that silver halide grains undergo gold sensitization. It is possible to employ combinations of a sensitizing method employing chalcogen sensitizers with the gold sensitizing method. Employed as chalcogen sensitizers usable in silver halide emulsions may be, for example, sulfur sensitizers, selenium sensitizers, and tellurium sensitizers, and of these, sulfur sensitizers are preferred. Listed as sulfur sensitizers are, for example, thiosulfates, allylthiocarbamidothiourea, allylisothiacyantes, cystine, p-toluenethiosulfonate, rhodanine, and inorganic sulfur. It is preferable to vary the added amount of sulfur sensitizers, depending on the types of silver halides emulsions, as well as the magnitude of desired effects. However the added amount is in the range of about $5\times10^{-10}$ to about $5\times10^{-5}$ mol per mol of silver halide, and is preferably in the range of $5\times10^{-8}$ to $3\times10^{-5}$ mol.

Added as gold sensitizers may be, for example, chloroauric acid, gold sulfide and various other gold complexes. Listed as usable ligand compounds may be, for example, dimethylrhodanine, thiocyanic acid, mercaptotetrazol, and mercaptotriazole. Further, preferred are gold sensitizers comprised of sensitizing components such as sulfur and selenium, and gold sensitizers having a group which forms silver sulfide or silver selenide.

The used amount of the aforesaid gold compounds varies depending on the kinds of silver halide emulsions, the types of used compounds, and ripening conditions, however, is preferably from $1\times10^{-4}$ to $1\times10^{-8}$, with more preferred amounts being from $1\times10^{-5}$ to $1\times10^{-8}$. Employed as chemical sensitizing methods of silver halide emulsions according to the present invention may be a reduction sensitizing method.

For the purpose of minimizing fog formed during preparation processes of light-sensitive materials, performance variation during storage, and fog formed during development, antifoggants as well as stabilizers, known in the art, may be incorporated in silver halide emulsions used to prepare light-sensitive materials of the present invention. Listed as examples of compounds which are employed to achieve the aforesaid purpose may be compounds represented by General Formula (II) described above. Further listed as more preferable specific compounds may be compounds (IIa-1) through (IIa-8) and (IIb-1) through (IIb-7) described above and compounds such as 1-(3-methoxyphenyl)-5-mercaptotetrazole and 1-(4-ethoxyphenyl-5-mercaptotetrazole. Based on the purposes, these compounds are added during any of the processes for preparing silver halide emulsion grains, and the chemical sensitization process, at the completion of the chemical sensitization process and the process for preparing coating composition. When chemical sensitization is performed in the presence of these compounds, they are preferably employed in an amount of about $1\times10^{-5}$ to about $5\times10^{-4}$ mol per mol of silver halide. When added at the completion of chemical sensitization, the added amount is preferably from about $1\times10^{-6}$ to about $1\times10^{-2}$ mol per mol of silver halide, and is more preferably from $1\times10^{-5}$ to $1\times10^{-3}$ mol. When added to a silver halide emulsion layer during process for preparing coating compositions, the added amount is preferably from about $1\times10^{-6}$ to about $1\times10^{-1}$, with the more preferred amount being from $1\times10^{-5}$ to $1\times10^{-2}$ mol. Further, when added to constitution layers other than silver halide emulsion layers, the amount is preferable so as to result in a coating of about $1\times10^{-9}$ to about $1\times10^{-3}$ mol per $m^2$.

For the purpose of minimizing irradiation as well as halation, dyes which absorb various wavelength regions may be employed in the light-sensitive materials of the present invention. For said purpose, any of the compounds known in the art may be employed. Preferably employed as dyes having absorption in the visible region are dyes AI-1 through -11 described on page 308 of Japanese Patent Application Open to Public Inspection No. 3-251840, dyes described in Japanese Patent Application Open to Public Inspection No. 6-3770, and dyes described in Japanese Patent Application Open to Public Inspection No. 11-119379. Preferred as infrared radiation absorbing dyes, are compounds represented by General Formula (I), (II), and (III) described in the lower left column on page 2 of Japanese Patent Application Open to Public Inspection No. 1-280750, which have preferred spectral characteristics, exhibit no adverse effects for photographic characteristics of silver halide photographic emulsions, and result in no staining due to residual color. Listed as specific examples of preferable compounds may be exemplified compounds (1) through (45) cited from the lower left column on page 3 to the lower left column on page 5 of the aforesaid patent publication. When these dyes are employed to improve sharpness, the preferable added amount is such that the spectral reflection density of unprocessed light-sensitive materials is at least 0.7 at 680 nm, and the more preferable added amount is that the same is at least 0.8.

Optical brightening agents are preferably incorporated in the light-sensitive materials of the present invention to improve background whiteness. Listed as preferably employed compounds are those represented by General Formal II described in Japanese Patent Application Open to Public Inspection No. 2-232652.

The silver halide light-sensitive color photographic materials of the present invention have layers comprising silver halide emulsions which are spectrally sensitized to the specified wavelength region of 400 to 900 nm, in combination with yellow couplers, magenta couplers and cyan couplers. Said silver halide emulsion comprises one type of a sensitizing dye or a combination of at least two types of sensitizing dyes.

Employed as spectral sensitizing dyes usable in the silver halide emulsions of the present invention are any of the several compounds known in the art. As blue-sensitive sensitizing dyes, BS-1 through -8, described on page 28 of Japanese Patent Application Open to Public Inspection No. 3-251840, may preferably be employed individually or in combination. Preferably employed as green-sensitive sensitizing dyes may be GS-1 through GS-5 described on page 28 of the aforesaid patent publication. Preferably employed as red-sensitive sensitizing dyes may be RS-1 through RS-8 described on page 29 of the aforesaid patent publication. When image exposure is carried out employing infrared radiation while utilizing a semiconductor laser, it is required to employ infrared-sensitive dyes. Preferably employed as infrared-sensitive sensitizing dyes are IRS-1 through IRS-11 described on pages 6 through 8 of Japanese Patent Application Open to Public Inspection No. 4-285950. Further, it is preferable that supersensitizers SS-1 through SS-9, described on pages 8 and 9 of Japanese Patent Application Open to Public Inspection No. 4-285950, or compounds S-1 through S-17, described on pages 15 through 17 of Japanese Patent Application Open to Public Inspection No. 5-66515, are employed while combined with these infrared-, red-, green-, and blue-sensitive sensitizing dyes. Each of these sensitizing dyes may be added at any time from the formation of silver halide grains to the completion of chemical sensitization.

Sensitizing dyes may be dissolved in water-compatible organic solvents such as methanol, ethanol, fluorinated alcohol, acetone, and dimethylformamide or water, and the resulting solution may be added. Alternatively, sensitizing dyes may be subject ed to solid dispersion followed by addition.

Employed as couplers employed in the silver halide light-sensitive color photographic materials of the present invention may be any compounds capable of forming coupling products having a maximum spectral absorption wavelengths in the longer wavelength region of more than 340 nm by undergoing coupling reaction with the oxidation product of a color developing agent. Specifically, representative compounds include yellow dye forming couplers having a maximum spectral absorption wavelength in the region of 350 to 500 nm, magenta dye forming couplers having a maximum spectral absorption wavelength in the region of 500 to 600 nm, and cyan dye forming couplers having a maximum spectral absorption wavelength in the region of 600 to 750 nm.

Listed as cyan couplers preferably usable in the silver halide light-sensitive color photographic materials of the present invention may be the couplers represented by General Formulas (C-I) and (C-II) described in the lower left column on page 5 of Japanese Patent Application Open to Public Inspection No. 4-114154. Listed as specific compounds may be those described as CC-1 through CC-9 from the lower right column on page 5 to the lower left column on page 6 of the aforesaid patent publication.

Listed as magenta couplers preferably usable in the silver halide light-sensitive color photographic materials of the present invention may be the couplers represented by General Formulas (M-I) and (M-II) described in the upper right column on page 4 of Japanese Patent Application Open to Public Inspection No. 4-114154. Listed as specific compounds may be those described as MC-1 through MC-11 from the lower left column on page 4 to the lower right column on page 5 of the aforesaid patent publication. Of the aforesaid magenta couplers, more preferred are the couplers represented by General Formula (M-I) described in the upper right column on page 4 of the aforesaid patent publication. Of these, particularly preferred are the couplers, in which RM of aforesaid General Formula (M-I) is a tertiary alkyl group, since excellent lightfastness is obtained. MC-8 to MC-11 described in upper column on page 5 of the aforesaid patent publication are preferred since those result in excellent color reproduction from blue to violent and red, as well as detailed reproduction.

Listed as yellow couplers preferably usable in the silver halide light-sensitive color photographic materials of the present invention may be the couplers represented by General Formula (Y-I) described in the upper right column on page 3 of Japanese Patent Application Open to Public Inspection No. 4-114154. Listed as specific compounds may be those described as YC-1 through YC-9 from the lower left column on page 3 to the following of the aforesaid patent publication. Of the aforesaid yellow couplers, preferred are couplers in which $RY_1$ in General Formula [Y-I] described in the aforesaid patent publication is an alkoxy coupler, or couplers represented by General Formula [I] described in Japanese Patent Application Open to Public Inspection No. 4-114154, since these are capable of reproducing yellow having preferred tints. Of these, particularly preferred are YC-8 and YC-9 described in the lower left column on page 4 of the aforesaid patent publication, as well as compounds represented by No. (1) through (47) described on pages 13 and 14 of Japanese Patent Application Open to Public Inspection No. 6-67388. Further, the most preferred compounds are those represented by [Y-1] described on page 1 and pages 11 through 17 of Japanese Patent Application Open to Public Inspection No. 4-81847.

Herein, described are addition methods of couplers as well as other organic compounds used in silver halide light-sensitive color photographic materials of the present invention. As one of the methods, when an oil-in-water type emulsification dispersion method is employed, the aforesaid couplers as well as organic compounds are dissolved in water-insoluble high-boiling point organic solvents, commonly having a boiling point of at least 150° C., if desired together with low-boiling point and/or water-soluble organic solvents, and the resulting mixture is subjected to emulsification dispersion into hydrophilic binders, such as an aqueous gelatin solution, employing surface active agents. Employed as dispersion means may be stirrers, homogenizers, colloid mills, flow jet mixers, and ultrasonic homogenizers. A process which removes low-boiling point organic solvents may be provided after dispersing or simultaneously during dispersion. Preferably employed as high-boiling point organic solvents usable for dissolving and dispersing couplers are, for example, phthalic acid esters such as dioctyl phthalate, diisodecyl phthalate, and dibutyl phthalate, phosphoric acid esters such as tricresyl phosphate and trioctyl phthalate, and alcohols. The dielectric constant of high-boiling point organic solvents is preferably from 3.5 to 7.0. Further, at least two types of high-boiling point organic solvents may be employed in combination.

On the other hand, instead of the aforesaid method, or while employed in combination with high-boiling point organic solvents, a method may be employed in which water-insoluble and organic solvent-soluble polymers are dissolved, if desired, in low-boiling point and/or water-soluble organic solvents, and subsequently, emulsification dispersion into hydrophilic binders such as an aqueous gelatin solution, is carried out employing various dispersion means. Listed as water-insoluble and organic solvent-soluble polymers employed for the above method may be poly(N-t-butylacrylamide).

Listed as preferred compounds as a surface active agent, which are employed to control surface tension during dispersion of photographic additives or during coating, are those having in a single molecule a hydrophobic group having from 8 to 30 cation atoms as well as a sulfonic acid group or salts thereof. Specifically listed are compounds A-1 through A-11 described in Japanese Patent Publication Open to Public Inspection No. 64-26854. Further, preferably employed are surface active agents in which the alkyl group is substituted with fluorine atom(s). These dispersions are commonly added to coating compositions comprising silver halide emulsions. The shorter the time until the addition to the coating composition after dispersion and the time until coating after the addition to the coating composition, the better. Each of these is preferably within 10 hours, is more preferably within three hours, and is still more preferably within 20 minutes.

In order to minimize fading of formed dye images due to light, heat and humidity, it is preferable that antifading agents are employed in combination. Particularly preferred compounds include phenyl ether based compounds represented by General Formulas I and II described on page 3 of Japanese Patent Publication Open to Public Inspection No. 2-66541, phenol based compounds represented by General formula IIB described in Japanese Patent Publication Open to Public Inspection No. 3174150, amine based compounds represented by General Formula A described in Japanese Patent Publication Open to Public Inspection No. 65-90445, and metal complexes represented by General Formulas XII, XIII, XIV, and XV described in Japanese Patent Publication Open to Public Inspection No. 62-182741, which are particularly preferable for magenta dyes. Further, the compounds represented by General Formula I' described in Japanese Patent Publication Open to Public Inspection No. 1-196049, as well as the compounds represented by General Formula described in Japanese Patent Publication Open to Public Inspection No. 5-11417 are particularly preferred for yellow and cyan dyes.

For the purpose of shifting the absorption wavelengths of dyes formed by color development, it is possible to use compound (d-11) described in the lower left column on page 9 of Japanese Patent Publication Open to Public Inspection No. 4-114154, and compound (A'-1) described in the lower left column on page 10 of the aforesaid patent publication. Other than these, it is possible to use fluorescent dye releasing compounds described in U.S. Pat. No. 4,774,187.

In the silver halide light-sensitive color photographic materials of the present invention, it is preferable that color contamination is minimized by adding compounds which react with the oxidation products of developing agents to the layer between light-sensitive layers, or fog is minimized by adding those to silver halide containing layers. Preferably employed as compounds for these purposes are hydroquinone derivatives. More preferred compounds include dialkylhydroquinones such as 2,5-t-octylhydroquinone. Listed as particularly preferred compounds are those represented by General Formula II described in Japanese Patent Application Open to Public Inspection No. 4-133056, which include compounds II-1 through II-14 described on pages 14 and 15 and compound 1 described on page 17 of the aforesaid patent publication.

It is preferable that by adding UV absorbers to the silver halide light-sensitive color photographic material of the present invention, static fog is minimized and the lightfastness of dye images is enhanced. Listed as preferred UV absorbers are benzortiazoles. Listed as particularly preferred compounds are those represented by General Formula III-3 described in Japanese Patent Application Open to Public Inspection No. 1-250944, the compounds represented by General Formula III described in Japanese Patent Application Open to Public Inspection No. 64-66646, UV-1L through UV-27L described in Japanese Patent Application Open to Public Inspection No. 63-187240, the compounds represented by General Formula I described in Japanese Patent Application Open to Public Inspection No. 4-1633, and the compounds represented by General Formulas (I) and (II) described in Japanese Patent Application Open to Public Inspection No. 5-165144.

It is advantageous to use gelatin as a binder in the silver halide light-sensitive color photographic materials of the present invention. If desired, it is possible to use other gelatin such as gelatin derivatives, graft polymers of gelatin with other polymers, proteins other than gelatin, sugar derivatives, cellulose derivatives, and hydrophilic colloid of synthetic hydrophilic polymers such as homopolymers or copolymers.

It is preferable that employed as a hardener of these binders are vinylsulfone type hardeners and chlorotriazine hardeners individually or in combination. It is preferable to employ t he compounds described in Japanese Patent Application Open to Public Inspection Nos. 61-249054 and 61-245153. In order to minimize an increase in mildew and bacteria, which adversely affect photographic performance as well as image retaining properties, it is preferable to add colloid layers antiseptics and mildewcides described in Japanese Patent Application Open to Public Inspection No. 3-157646. Further, in order to enhance physical properties of light-sensitive materials or the surface of processed samples, it is preferable that slipping agents and matting agents are added which are described in Japanese Patent Application Open to Public Inspection Nos. 6-118543 and 2-73250.

The supports employed to prepare the light-sensitive materials of the present invention may be comprised of any of a number of materials, and include paper coated with polyethylene or polyethylene terephthalate, paper supports comprised of natural pulp or synthetic pulp, vinyl chloride sheets, polypropylene or polyethylene terephthalate supports which may comprise white pigments, and baryta paper. Of these, supports are preferred which comprise a base paper having on both sides water resistant resinous coating layers. Preferred as water resistant resins are polyethylene and polyethylene terephthalate, or copolymers thereof.

White pigments employed in supports include inorganic and/or organic white pigments. Of these, inorganic white pigments are preferably employed. Listed as inorganic white pigments are, for example, sulfates of alkaline earth metals such as barium sulfate, carbonates of alkaline earth metals such as calcium carbonate, silica such as fine silicate powders and synthetic silicates, calcium silicate, alumina, alumina hydrates, titanium oxide, zinc oxide, talc, and clay. Of these, white pigments, barium sulfate and titanium oxide are preferred.

In order to improve sharpness, the proportion of white pigments incorporated in the water resistant resinous layer on the surface of a support is preferably at least 13 percent by weight, and is more preferably at least 15 percent.

In the paper supports employed in the light-sensitive materials of the present invention, it is possible to determine the degree of dispersion of white pigment in the water resistant resinous layer, employing the method described in Japanese Patent Application Open to Public Inspection No. 2-28640. When employing this method, the degree of dispersion of a white pigment is preferably at most 0.20 in terms of the variation coefficient described in the aforesaid patent publication, and is more preferably at most 0.15.

Further, the central surface mean roughness (SRa) of supports is preferably at most 0.15 $\mu$m, and is more preferably at most 0.12 $\mu$m, resulting in effects for enhanced glossiness. Further, in order to regulate the balance of spectral reflection density of the white portion after processing so as to enhance whiteness, it is preferable that a minute amount of bluing agents, and red providing agents such as ultramarine and oil-soluble dyes, or optical brightening agents is added into water-resistant resins comprising white pigments of the reflection support and coated hydrophilic colloid layers.

In the light-sensitive materials of the present invention, if desired, the support surface may be subjected to corona discharge, UV irradiation, or a flaming treatment, and subsequently, each of the photographic constitution layers may be applied directly onto a support or via sublayer(s) (one or more layers to enhance the adhesion properties of the support surface, antistatic properties, dimensional stability, abrasion resistance, hardness, antihalation properties, friction characteristics and/or other characteristics) onto a support.

During coating of light-sensitive photographic materials employing silver halide emulsions, viscosity increasing agents may be employed to enhance coatability. As coating methods, extrusion coating as well as curtain coating, capable of simultaneously coating at least two layers, is particularly useful.

Photographic images are formed on the light-sensitive materials of the present invention as follows. An image recorded on a negative film may be optically focused on a light-sensitive material which is used to make prints and then printed; after temporarily converting an image into digital information, an image is formed on a CRT (cathode ray tube) and the resulting image is focused on a light-sensitive material which is used to make prints and then printed; or printing may be carried out through scanning based on digital information, under varying laser beam intensity.

The present invention is preferably applied to light-sensitive materials which do not comprise developing agents in their interior, and particularly to light-sensitive materials which form images for direct viewing. Listed as such light-sensitive materials are, for example, color paper, color reversal paper, positive image forming light-sensitive materials, light-sensitive materials for display, and light-sensitive materials for color proofs. The application to light-sensitive materials comprising a reflection support is particularly preferred.

Employed as aromatic primary amine developing agents may be any of the compounds known in the art. Listed as examples of such compounds are those described below:

CD-1: N,N-diethyl-p-phenylenediamine

CD-2: 2-amino-5-diethylaminotoluene

CD-3: 2-amino-5-(N-ethyl-N-laurylamino)toluene

CD-4: 4-(N-ethyl-N-(β-hydroxyethyl)amino)aniline

CD-5: 2-methyl-4-(N-ethyl-N-(β-hydroxyethyl)amino) aniline

CD-6: 4-amino-3-methyl-N-(β-(methanesufonamido) ethyl)aniline

CD-7: N-(2-amino-5-diethylaminophnylethyl) methanesulfoneamide

CD-8: N,N-dimethyl-p-phenylenediamine

CD-9: 4-amino-3-methyl-N-ethyl-N-metjoxyethylaniline

CD-10: 4-amino-3-methyl-N-ethyl-N-(β-ethoxyethyl) aniline

CD-11: 4-amino-3-methyl-N-ethyl-N-(γ-hydoxypropyl) aniline

In the present invention, the aforesaid color developing agents are employed in the optional pH range. However, from the viewpoint of quick processing, the pH is preferably in the range of 9.5 to 13.0, and is more preferably in the range of 9.8 to 12.0.

The temperature of color development is preferably from 35 to 70° C. It is preferable to increase the temperature to reduce the processing time. On the other hand, from the viewpoint of stability of the processing solution, it is preferable to maintain the temperature at a relatively low level. It is therefore preferable to carry out processing between 37 and 60° C.

Color development is commonly carried out over approximately 3 minutes 30 seconds. However, in the present invention, color development is preferably carried out within 40 seconds, and is more preferably carried out within 25 seconds.

It is possible to add known developer component compounds to the color developing solution in addition to the aforesaid color developing agents. Generally employed are alkali agents exhibiting a pH buffering action, chloride ions, development restrainers such as benzortiazoles, preserving agents, and chelating agents.

The light-sensitive materials of the present invention are bleached and fixed after color development. The bleaching may be simultaneously carried out with the fixing. Generally, washing is carried out after the fixing. Further, instead of washing, a stabilization process may be carried out. Employed as photographic processors, in which the light-sensitive materials of the present invention are subjected to photographic processing, may be a roller transport type processor in which light-sensitive materials are transported while interposed between rollers arranged in processing tanks, and an endless belt type processor in which light-sensitive materials are fixed onto a belt and transported. Further, the following systems may also be employed: a system in which processing tanks are shaped so as to form a slit and while supplying processing solution to processing tanks, light-sensitive materials are transported; a spray system in which processing solutions are sprayed; a web system in which light-sensitive materials are brought into contact with bodies impregnated with processing solutions; and a system which utilizes viscous processing solutions. When a large amount of light-sensitive materials are processed, a running process is usually carried out employing an automatic processor. In such a case, the less the replenishment rate of a replenisher, the better. From the viewpoint of environmental protection, the most preferable processing embodiment is that as a replenishment method, processing agents are added in the form of tablets, and the method described in Kokai Gihou (Japanese Technical Disclosure) No. 94-16935 is most preferred.

EXAMPLES

The present invention will now be described with reference to examples. However the embodiments of the present invention are not limited to these examples.

Example 1

Preparation of Silver Halide Emulsions (Preparation of Silver Halide Emulsion G-1)

Simultaneously added to 1 liter of a 2 percent aqueous gelatin solution maintained at 40° C. were Solution A1 and Solution B1, described below, over 20 minutes while adjusting the pAg and the pH to 7.3 and 3.0, respectively. Subsequently, Solutions A2 and B2, described below, were simultaneously added over 100 minutes while adjusting the pAg and the pH to 8.0 and 5.5, respectively. Thereafter, Solutions A3 and B3, described below, were simultaneously added over 5 minutes while adjusting the pAg and the pH to 8.0 and 5.5, respectively. During such operations, the pAg was controlled employing the method described in Japanese Patent Publication Open to Public Inspection No. 59-45437, while the pH was suitably controlled by adding an aqueous sulfuric acid or sodium hydroxide solution.

(Solution A1)

Sodium chloride 0.48 g

Potassium bromide 0.004 g

Water to make 28 ml (Solution A2)

Sodium chloride 116.9 g

Potassium bromide 0.12 g $K_2IrCl_6$ $1.0\times10^{-5}$ g $K_4Fe(CN)_6.3H_2O$ $9.3\times10^{-3}$ g Water to make 597 ml (Solution A3)

Sodium chloride 12.5 g $K_2IrCl_6$ $5.5\times10^{-7}$ g $K_4Fe(CN)_6.3H_2O$ $4.6\times10^{-4}$ g Water to make 64 ml (Solution B1)

Silver nitrate 1.4 g

Water to make 28 ml (Solution B2)

Silver nitrate 341 g

Water to make 597 ml (Solution B3)

Silver nitrate 35.6 g

Water to make 64 ml

After adding each of the aforesaid solutions, desalting was carried out employing a 5 percent Demol N (manufactured by Kao Atlas Co.) solution and a 20 percent aqueous magnesium sulfate solution. Subsequently, the resulting product was mixed with an aqueous gelatin solution, whereby Silver Halide Emulsion G-1, comprised of monodispersed cubic grains, was prepared, which had an average grain diameter of 0.40 μm, a variation coefficient of the grain size distribution of 0.08, and a silver chloride content of 99.8 mol percent.

(Preparation of Silver Halide Emulsions G-2 Through G-6)

Silver Halide Emulsions G-2 through G-6, which had Characteristic Value A (silver bromide containing mol percent existing in the range of a depth of 0.006 μm from the silver halide grain surface/silver mol) and Characteristic Value B (the region where the silver bromide containing layer according to the present invention is present), described in Table 1, were prepared in the same manner as aforesaid Silver Halide Emulsion G-1, except that the added amount of bromide (KBr) in Solution A3 was suitably regulated. Further, Silver Halide Emulsion G-6, which had Characteristic Values A and B, described in Table 1, was prepared by suitably varying the added amount of Solutions A2, A3, B2, and B3, along with the aforesaid variations. Incidentally, Characteristic Value B was expressed employing a distance (in μm) when the silver halide grain surface was taken to be 0 μm.

TABLE 1

| Silver Halide Emulsion Number | Characteristic Value A (in mol % / mol of silver) | Characteristic Value B (in μm) |
|---|---|---|
| G-1 | — | 13 |
| G-2 | 0.4 | 0–0.006 |
| G-3 | 1.0 | 0–0.006 |
| G-4 | 4.0 | 0–0.006 |
| G-5 | 7.0 | 0–0.006 |
| G-6 | 4.0 | 0.002–0.006 |

(Preparation of Silver Halide Emulsions G-7 Through G-13)

Silver Halide Emulsions G-7 through G-13, which had Characteristic Values A and B, and Characteristic Value C (the depth of the region where complexes having a cyano ligand or a carbon atom containing complexes were present) were prepared in the same manner as aforesaid Silver Halide Emulsion G-1, except that the added amount of Solutions A2, A3, B2 and B3, as well as the added amount of the cyano ligand complexes and carbon atom containing complexes, were suitably varied, or were combined. Incidentally, Characteristic Values B and C were expressed employing a distance (in μm) when the silver halide grain surface was taken to be 0 μm.

TABLE 2

| Silver Halide Emulsion Number | Characteristic Value A (in mol % /mol of silver) | Characteristic Value B (in μm) | Characteristic Value C: Depths (in μm) | Characteristic Value C: Added Compound |
|---|---|---|---|---|
| G-7 | 0 | — | 0–0.13 | Exemplified Compound A1 |
| G-8 | 0 | — | 0.006–0.13 | Exemplified Compound A1 |
| G-9 | 0 | — | 0.006–0.13 | Exemplified Compound B3 |
| G-10 | 0 | — | 0.009–0.13 | Exemplified Compound A1 |
| G-11 | 0 | — | 0.02–0.13 | Exemplified Compound A1 |
| G-12 | 4.0 | 0–0.003 | 0.003–0.13 | Exemplified Compound A1 |
| G-13 | 4.0 | 0–0.006 | 0.006–0.13 | Exemplified Compound A1 |

(Preparation of Green-sensitive Silver Halide Emulsions G2-1 Through G2-13)

Each of the additives, described below, was added in the stated order to each of Silver Halide Emulsions G-1 through G-13 prepared as above at an interval of one minute, and the resulting mixture was maintained at 65° C. After 70 minutes, STAB-1 was added so as to result in optimal sensitivity and the resulting mixture underwent chemical ripening so that the relationship between fog and sensitivity was optimized, whereby Green-Sensitive Silver Halide Emulsions G2-1 through G2-13 were prepared.

| Additive | Added Amount |
|---|---|
| 1: Sensitizing dye (GS-1) | $4 \times 10^{-4}$ mol/mol of AgX |
| 2: Chloroauric acid | $1.5 \times 10^{-5}$ mol/mol of AgX |
| 3: STAB-1 (antifoggant) | $1.2 \times 10^{-4}$ mol/mol of AgX |
| 4: Sodium thiosultate | 30 mol percent with respect to chloroauric acid |

(Preparation of Blue-Sensitive Silver Halide Emulsion B2-1)

Silver Halide Emulsion B-1 comprised of monodispersed cubic grains, which had an average grain diameter of 0.64 μm, a variation coefficient of the grain size distribution of 0.07, and a silver chloride content of 99.5 mol percent, was prepared in the same manner as aforesaid Silver Halide Emulsion G-1, except that the addition time of Solutions Al, B1, A2, B2, A3, and B3 was suitably varied.

Each of the additives, described below, was added at 65° C. in the stated order to aforesaid Silver Halide Emulsion B-1 at an interval of one minute, and the resulting mixture underwent chemical ripening so that the relationship between fog and sensitivity was optimized, whereby Blue-Sensitive Silver Halide Emulsion B2-1 was prepared.

| | |
|---|---|
| 1: Sodium thiosulfate | 0.8 mg/mol of AgX |
| 2: Chloroauric acid | $1.5 \times 10^{-5}$ mol/mol of AgX |
| 3: Stabilizer (STAB-1) | $3 \times 10^{-4}$ mol/mol of AgX |
| 4: Sensitizing dye (BS-1) | $4 \times 10^{-4}$ mol/mol of AgX |
| 5: Sensitizing dye (BS-2) | $1 \times 10^{-4}$ mol/mol of AgX |

(Preparation of Red-Sensitive Silver Halide Emulsion R2-1)

Silver Halide Emulsion R-1, comprised of monodispersed cubic grains, which had an average grain diameter of 0.40 μm, a variation coefficient of the grain size distribution of 0.08, and a silver chloride content of 99.5 mol percent, was prepared in the same manner as aforesaid Silver Halide Emulsion G-1, except that the addition time of Solutions A1, B1, A2, B2, A3, and B3 was suitably varied.

Each of the additives, described below, was added at 65° C. in the stated order to aforesaid Silver Halide Emulsion R-1 at an interval of one minute, and the resulting mixture underwent chemical ripening so that the relationship between fog and sensitivity was optimized, whereby Red-Sensitive Silver Halide Emulsion R2-1 was prepared.

| | |
|---|---|
| 1: Sodium thiosulfate | 1.8 mg/mol of AgX |
| 2: Chloroauric acid | $1.5 \times 10^{-5}$ mol/mol of AgX |
| 3: Stabilizer (STAB-1) | $1.2 \times 10^{-4}$ mol/mol of AgX |
| 4: Sensitizing dye (RS-1) | $1 \times 10^{-4}$ mol/mol of AgX |
| 5: Sensitizing dye (RS-2) | $1 \times 10^{-4}$ mol/mol of AgX |

STAB-1: 1-(3-acetoamidophenyl)-5-mercaptotetrazole

Alternatively, SS-1 was added to Red-Sensitive Silver Halide Emulsion R2-1 in an amount of $2.0\times10^{-3}$ g per mol of silver halide.

BS-1

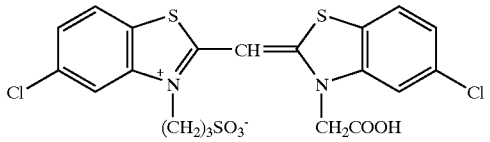

BS-2

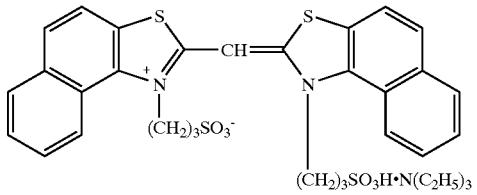

GS-1

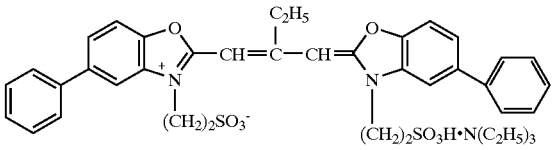

RS-1

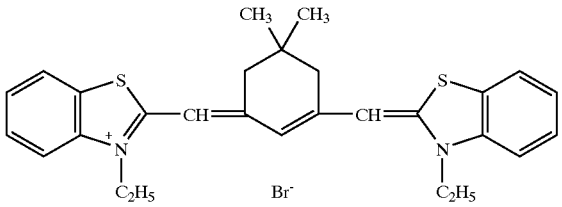

RS-2

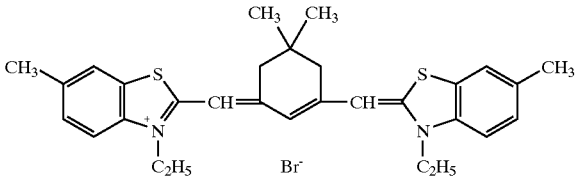

SS-1

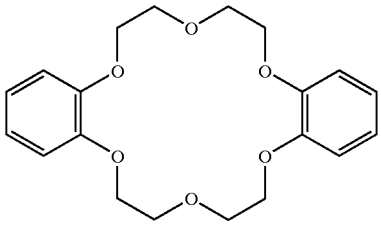

Preparation of Silver Halide Photographic Color Materials (Preparation of Sample 1)

An emulsion layer coating surface of paper pulp, having a basis weight of 180 g/m$^2$, was laminated with fused high density polyethylene comprising dispersed surface-treated anatase type titanium oxide in an amount of 15 percent by weight, while the opposite surface was laminated with high density polyethylene. The resulting reflection support was subjected to a corona discharge treatment, and was then provided with a gelatin sublayer. Further, the resulting support was coated with each of the photographic constitution layers comprised of materials described in Tables 3 and 4, whereby Sample 1 was prepared which was the silver halide light-sensitive color photographic material.

Incidentally, added as a hardener were (H-1) and (H-2) to the second layer, the fourth layer and the seventh layer. Further, added as a coating aid to control the surface tension, were surface active agents (SU-2) and (SU-3) to each layer. Still further, added was antifungal agent (F-1) to each layer so that the total amount reached 0.4 g/m$^2$. Incidentally, the amount of the silver halide emulsion in the table was represented in terms of silver.

TABLE 3

| Layer | Composition | Added amount (in g/m$^2$) |
|---|---|---|
| Seventh Layer (Protective Layer) | Gelatin | 0.70 |
| | DIDP | 0.002 |
| | DBP | 0.002 |
| | carbon dioxide | 0.003 |
| Sixth Layer (UV Absorbing Layer) | Gelatin | 0.40 |
| | Al-1 | 0.01 |
| | UV Absorber (UV-1) | 0.07 |
| | UV Absorber (UV-2) | 0.12 |
| | Antistaining Agent (HQ-5) | 0.02 |
| Fifth Layer (Red-Sensitive Layer) | gelatin | 1.00 |
| | Red-Sensitive Silver chlorobromide Emulsion (R2-1) | 0.17 |
| | Cyan Coupler (C-1) | 0.22 |
| | Cyan Coupler (C-2) | 0.06 |
| | Dye Image Stabilizer (ST-1) | 0.06 |
| | Antistaining Agent (HQ-1) | 0.003 |
| | DBP | 0.10 |
| | DOP | 0.20 |
| Fourth Layer (UV Absorbing Layer) | gelatin | 0.94 |
| | Al-1 | 0.02 |
| | UV Absorber (UV-1) | 0.17 |
| | UV Absorber (UV-2) | 0.27 |
| | Antistaining Agent (HQ-5) | 0.06 |

TABLE 4

| Layer | Composition | Added amount (in g/m$^2$) |
|---|---|---|
| Third Layer (Green-Sensitive Layer) | gelatin | 1.30 |
| | Al-2 | 0.01 |
| | Green-Sensitive Silver Chlorobromide Emulsion (G2-1) | 0.12 |
| | Magenta Coupler (M-1) | 0.05 |
| | Magenta Coupler (M-2) | 0.15 |
| | Dye Image Stabilizer (ST-3) | 0.10 |
| | Dye Image Stabilizer (ST-4) | 0.02 |
| | DIDP | 0.10 |
| | DBP | 0.10 |
| Second Layer (Inter-layer) | gelatin | 1.20 |
| | Al-3 | 0.01 |
| | Antistaining Agent (HQ-1) | 0.02 |
| | Antistaining Agent (HQ-2) | 0.03 |
| | Antistaining Agent (HQ-3) | 0.06 |
| | Antistaining Agent (HQ-4) | 0.03 |
| | Antistaining Agent (HQ-5) | 0.03 |
| | DIDP | 0.04 |
| | DBP | 0.02 |

TABLE 4-continued

| Layer | Composition | Added amount (in g/m$^2$) |
|---|---|---|
| First Layer (Blue-Sensitive Layer) | Gelatin | 1.10 |
| | Blue-Sensitive Silver Chlorobrimide Emulsion (B2-1) | 0.24 |
| | Yellow Coupler (Y-1) | 0.10 |
| | Yellow Coupler (Y-2) | 0.30 |
| | Yellow Coupler (Y-3) | 0.05 |
| | Dye Image Stabilizer (ST-1) | 0.05 |
| | Dye Image Stabilizer (ST-2) | 0.05 |
| | Dye Image Stabilizer (ST-5) | 0.10 |
| | Antistaining Agent (HQ-1) | 0.005 |
| | Image Stabilizer A | 0.08 |
| | Image Stabilizer B | 0.04 |
| | DNP | 0.05 |
| | DBP | 0.15 |
| Support | polyethylene laminated paper (containing a minute amount of colorants) | |

Each additive employed to prepare Sample 1 will now be detailed.

SU-1: sodium tri-i-propylnaphthalenesulfonate

SU-2: sodium 2-ethylhexylsulfosuccinate

SU-3: sodium 2,2,3,3,4,4,5,5-octafluoropentylsufosuccinate

DBP: dibutyl phthalate

DNP: dinonyl phthalate

DOP: dioctyl phthalate

DIDP: di-i-decyl phthalate

TOP: trioctyl phosphate

H-1: tetrakis(vinylsulfonylmethyl)methane

H-2: sodium 2,4-dichloro-6-hydroxy-s-triazine

HQ-1: 2,5-di-t-octylhydroquinone

HQ-2: 2,5-di-sec-dodecylhydroquinone

HQ-3: 2,5-di-sec-tetradecylhydroquinone

HQ-4: 2-sec-dodecyl-5-sec-tatradecylhydroquinone

HQ-5: 2,5-di[(1,1-dimethyl-4-hexyloxycarbonyl)butyl] hydroquinone

Image Stabilizer A: P-t-octylphenol

Image Stabilizer B: poly(t-butylacrylamide)

Y-1

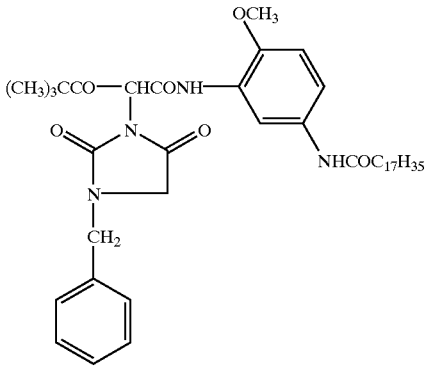

Y-2

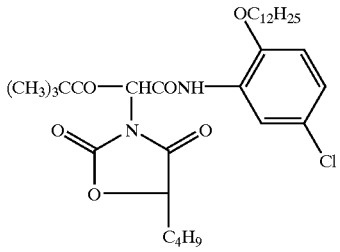

Y-3

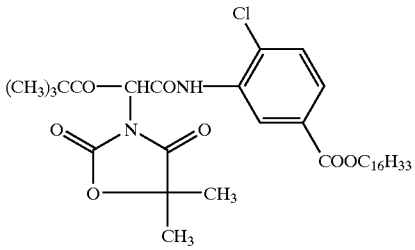

M-1

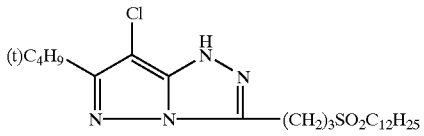

M-2

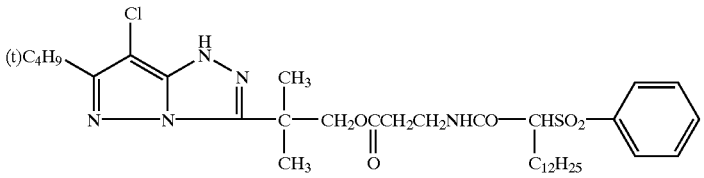

-continued
C-1
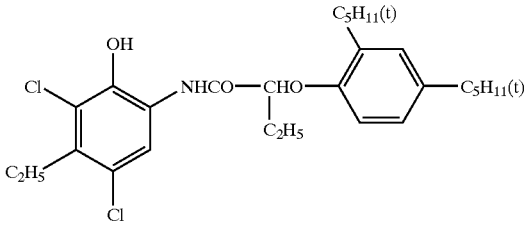
C-2
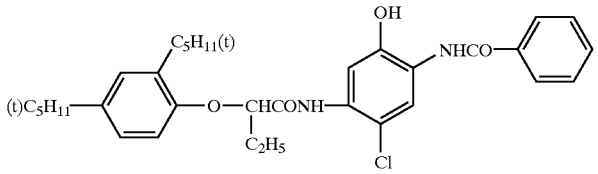
ST-1
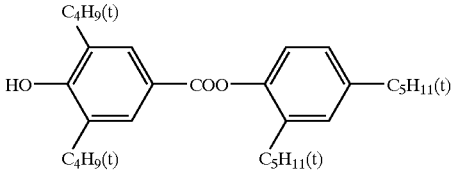
ST-2
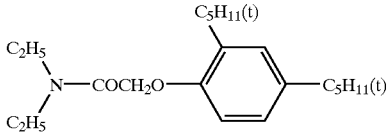
ST-3
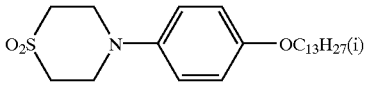
ST-4
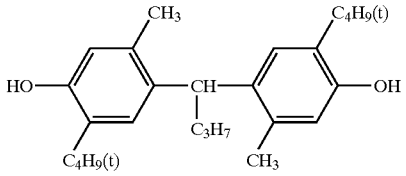
ST-5
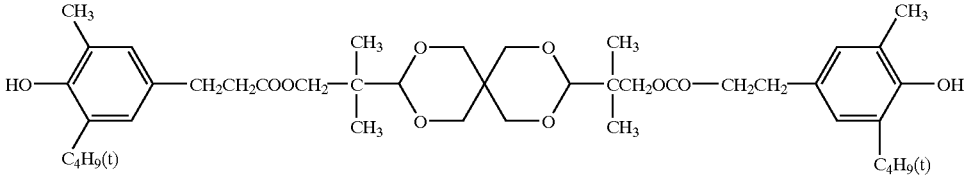
Al-1
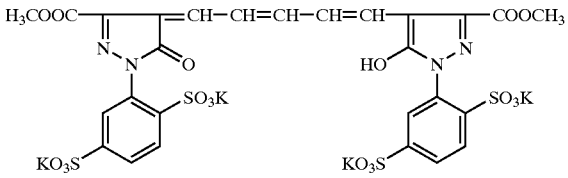
Al-2
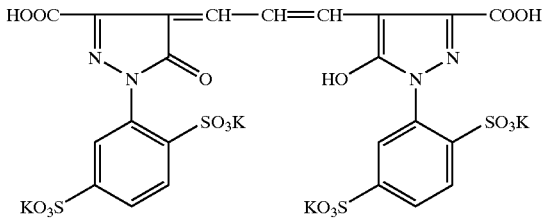
Al-3
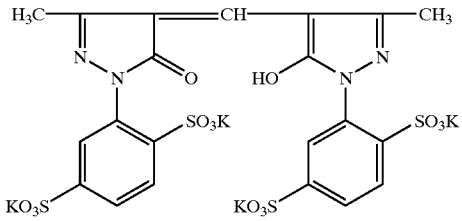
F-1
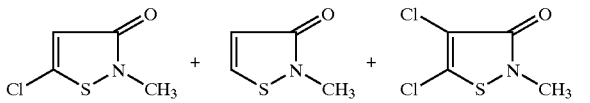
(50%) (46%) (4%) Mol Ratio
Mixture of mol ratio (50:46:4)
UV-1
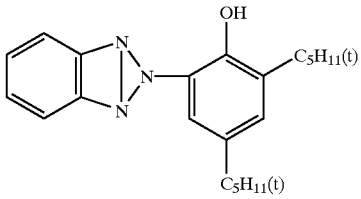
UV-2
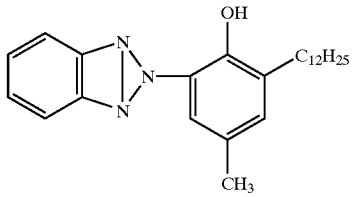

(Preparation of Samples 2 through 13)

<Preparation of Blue-Sensitive and Red-Sensitive Silver Halide Emulsions B2-2 Through B2-13 and R2-2 Through R2-13>

Silver halide emulsions were prepared so as to exhibit the same characteristics as each silver halide emulsion used to prepare the aforesaid Green-Sensitive Silver Halide Emulsions G2-2 through G2-13. Subsequently, Blue-Sensitive Silver Halide Emulsions B2-2 through B2-12 and Red-Sensitive Silver Halide Emulsions R2-2 through R2-13 were prepared, which underwent chemical sensitization and spectral sensitization in the same manner as the aforesaid Blue-Sensitive Silver Halide Emulsion B2-1 as well as Red-Sensitive Silver Halide Emulsion R2-1.

<Preparation of Silver Halide Light-Sensitive Color Photographic Materials>

Samples 2 through 13 were prepared in the same manner as the aforesaid Sample 1, except that Blue-Sensitive Silver Halide Emulsion B2-1, Green-Sensitive Silver Halide Emulsion G2-1, and Red-Sensitive Silver Halide Emulsion R2-1 were replaced with each of Blue-Sensitive Silver Halide Emulsions B2-2 through B2-12, Green-Sensitive Silver Halide Emulsions G2-2 through G2-13, and Red-Sensitive Silver Halide Emulsions R2-2 through R2-13.

Evaluation of Silver Halide Light-Sensitive Color Photographic Materials

The processing stability as well as the latent image stability of Samples 1 through 13, prepared as above, was evaluated employing the methods described below.

(Evaluation of Processing Stability)

Each sample was subjected to wedge exposure for $10^{-6}$ second, employing a high intensity xenon flash sensitometer (Type SX-20, manufactured by Yamashita Denso Co., Ltd.). The exposed sample was subjected 10 minutes after exposure to Color Photographic Processing 1 based on the photographic process described below. On the other hand, the exposed sample was subjected to Color Photographic Processing 2 in the same manner as Color Photographic Processing 1, except that the color developer was replaced with one which was mixed with a bleach-fixer in an amount of 1.3 ml per liter of the color developer.

The reflection magenta density of the magenta image of each sample, which had been subjected to the photographic processing above, was determined employing an optical densitometer (Type PDA-65, manufactured by Konica Corp.), and a characteristic curve was prepared in which the ordinate represented the reflection density (D) and the abscissa represented the exposure amount (LogE). Based on Formula 1 described below, gradation γ (γ1) of Color Photographic Processing 1 as well as gradation γ (γ2) of Color Photographic Processing 2 was determined. Subsequently, variation value ΔγA was calculated according to Formula 2 described below, based on each gradation γ value. Incidentally, as the value of ΔγA approaches 100, the processing stability is enhanced.

Gradation $\gamma = 1/[\text{Log(exposure amount to result in density of fog plus 0.5)} - \text{Log(exposure amount to result in density of fog plus 1.5)}]$ Formula 1

$\Delta\gamma A = (\gamma 2/\gamma 1) \times 100$ Formula 2

(Evaluation of Latent Image Stability)

Each sample was subjected to wedge exposure for $10^{-6}$ second, employing a high intensity xenon flash sensitometer (Type SX-20, manufactured by Yamashita Denso Co., Ltd.). The sample was left alone for 5 minutes after exposure and was subjected to Color Photographic Processing 3 in the same manner as Color Photographic Processing 1 described below. On the other hand, each sample was subjected to exposure employing the aforesaid method, and after 5 seconds, the exposed sample was subjected to Color Photographic Processing 4 in the same manner.

The reflection magenta density of the magenta image of each sample which had been subjected to photographic processing as above was determined employing an optical densitometer (PDA-65 type, manufactured by Konica Corp.), and a characteristic curve was prepared in which the ordinate represented the reflection density (D) and the abscissa represented the exposure amount (LogE). Based on Formula 3 described below, gradation γ (γ3) of Color Photographic Processing 3 as well as gradation γ (γ4) of Color Photographic Processing 4 was determined. Subsequently, variation value ΔγB was calculated according to Formula 4 described below, based on each gradation γ value. Incidentally, as the value of ΔγB approaches 100, the latent image stability is enhanced.

Gradation $\gamma = 1/[\text{Log(exposure amount to result in density of fog plus 0.1)} - \text{Log(exposure amount to result in density of fog plus 0.4)}]$ Formula 3

$\Delta\gamma B = (\gamma 4/\gamma 3) \times 100$ Formula 4

(Color Photographic Processing 1)

| Processing Step | Processing Temperature | Time | Replenishment Rate |
|---|---|---|---|
| Color Development | 38.0 ± 0.3° C. | 45 seconds | 80 ml |
| Bleach-Fixing | 35.0 ± 0.5° C. | 45 seconds | 120 ml |
| Stabilization | 30–34° C. | 60 seconds | 150 ml |
| Drying | 60–80° C. | 30 seconds | |

(Compositions of Each Processing Solution of Color Photographic Processing 1)

<Color Developer Tank Solution and its Replenisher)

| | Tank Solution | Replenisher |
|---|---|---|
| Pure water | 800 ml | 800 ml |
| Triethylenediamine | 2 g | 3 g |
| Diethylene glycol | 10 g | 10 g |
| Potassium bromide | 0.01 g | — |
| Potassium chloride | 3.5 g | |
| Potassium sulfite | 0.25 g | 0.5 g |
| N-ethyl-N-(βmethanesulfonamidoethyl)-3-methyl-4-aminoaniline sulfate | 6.0 g | 10.0 g |
| N,N-diethylhydroxylamine | 6.8 g | 6.0 g |
| Triethanolamine | 10.0 g | 10.0 g |
| Sodium diethylenetriamoinepentaacetate | 2.0 g | 2.0 g |
| Optical brightening agent (4,4'-diamonostilbene-disulfonic acid derivative) | 2.0 g | 2.5 g |
| Potassium carbonate | 30 g | 30 g |

Each total volume was adjusted to 1 liter by adding water. The pH of the tank solution and the replenisher was adjusted to 10.10 and 10.60, respectively.

<Bleach-Fixer Tank Solution and its Replenisher>

Diethylenetriaminepentaacetatoiron(II) ammonium dihydrate salt 65 g

Diethylenetriamnepentaacetic acid 3 g

Ammonium thiosulfates (70 percent aqueous solution 100 ml

2-Amino-5-mercapto-1,3,4-thiadiazole 2.0 g

Ammonium sulfite (40 percent aqueous solution) 27.5 ml

Water to make 1 liter

The pH was adjusted to 5.0 by adding potassium carbonate or glacial acetic acid.

<Stabilizer Tank Solution and its Replenisher> o-Phenylphenol 1.0 g

5-Chloro-2-methyl-4-isothiazoline-3-one 0.02 g

2-Methyl-4-isothiazoline-3-one 0.02 g

Diethylene glycol 1.0 g

Optical brightening agent (Cinopal SFP) 2.0 g

1-Hydoxyethylidene-1,1-disulfonic acid 1.8 g

Bismuth chloride (45 percent aqueous solution) 0.65 g

Magnesium sulfate heptahydrate 0.2 g

PVP (polyvinylpyrrolidone) 1.0 g

Aqueous ammonia (25 percent aqueous ammonium hydroxide) 2.5 g

Trisodium nitrilotriacetate 1.5 g

Water to make 1 liter

The pH was adjusted to 7.5 by adding sulfuric acid or aqueous ammonia.

Table 5 shows the obtained results.

TABLE 5

| Sample No. | Processing Stability ΔγA | Latent Image Stability ΔγB | Remarks |
|---|---|---|---|
| 1 | 116 | 119 | Comparative Example |
| 2 | 110 | 112 | Comparative Example |
| 3 | 105 | 105 | Present Invention |
| 4 | 103 | 104 | Present Invention |
| 5 | 94 | 87 | Comparative Example |
| 6 | 101 | 102 | Present Invention |
| 7 | 121 | 75 | Comparative Example |
| 8 | 105 | 102 | Present Invention |
| 9 | 105 | 103 | Present Invention |
| 10 | 104 | 106 | Present Invention |
| 11 | 107 | 118 | Comparative Example |
| 12 | 104 | 105 | Present Invention |
| 13 | 103 | 100 | Present Invention |

As can clearly be seen from Table 5, each sample employing the silver halide emulsion, which exhibited the characteristics specified by the present invention, exhibited excellent processing stability as well as excellent latent image stability, compared to the comparative samples. Specifically, Samples 3 and 4 are preferred due to minimal variation of latent image stability, compared to Comparative Sample 5. Further, Samples 8 through 10, 12 and 13 exhibited excellent processing stability as well as latent image stability, compared to Comparative Samples 7 and 11. As a result, it was proved that the resultant performance depended markedly on the existing region of the compounds of the present invention. It was possible to confirm that Sample 13 according to claims 1 and 2 exhibited pronounced effects of the present invention.

Example 2

Preparation of Silver Halide Emulsions (Preparation of Green-Sensitive Silver Halide Emulsions G2-14 through G2-19)

Silver Halide Emulsions G2-14 was prepared upon being subjected to chemical sensitization in the same manner as silver Halide Emulsion G2-1 in Example 1, except that KBr was added in an amount of 0.28/mol of AgX 5 minutes after adding the specified amount of STAB-1. Subsequently, Silver Halide Emulsions G2-15 through G2-19 were prepared in the same manner as Silver Halide Emulsion G2-14, except that the first addition of KBr and the first and second addition intervals were varied as shown in Table 6. The first and the second added amounts of KBr were fixed at 0.28 g/mol of Ag.

TABLE 6

| Silver Halide Emulsion No. | Addition Frequency of Bromide | First Addition Time of Bromide | First and Second Addition time Interval (in minutes) | Second Addition Time of Bromide | Remarks |
|---|---|---|---|---|---|
| G2-14 | 2 | 5 minutes after adding STAB | — | — | Comp. |
| G2-15 | 2 | 5 minutes after adding STAB | 70 | 5 minutes prior to addition of STAB | Inv. |
| G2-16 | 2 | 5 minutes after adding STAB | 70 | 5 minutes prior to addition of STAB | Inv. |
| G2-17 | 2 | 5 minutes after adding STAB | 70 | 5 minutes prior to addition of STAB | Inv. |
| G2-18 | 2 | 5 minutes after adding STAB | 50 | 5 minutes prior to addition of STAB | Comp. |
| G2-19 | 2 | 5 minutes after adding STAB | 120 | 5 minutes prior to addition of STAB | Inv. |

Comp.: Comparative Example
Inv.: Present Invention (Preparation of Blue-Sensitive Silver Halide Emulsions B2-14 Through B2-19 and Red-Sensitive Silver Halide Emulsions R2-14 Through R2-19)

Blue-Sensitive Silver Halide Emulsions B2-14 through B2-19 and Red-Sensitive Silver Halide Emulsions R2-14 through R2-19 were prepared in the same manner as the aforesaid Silver Halide Emulsions G2-14 through G2-19.

Preparation of Silver Halide Light-Sensitive Color Photographic Materials and Evaluation Thereof Samples 14 through 19 were prepared in the same manner as Sample 1 described in Example 1, except that Blue-Sensitive Emulsion B2-1, Green-Sensitive Emulsion G2-1, and Red-Sensitive Emulsion R2-1 were replaced with each of Blue-Sensitive Emulsions B2-14 through B2-19, Green-Sensitive Emulsions G2-14 through 19, and Red-Sensitive Emulsions R2-14 through R2-19. The processing stability, as well as the latent image stability of each sample, was evaluated in accordance with the methods described in Example 1. Table 7 shows the obtained results.

TABLE 7

| Sample No. | Processing Stability ΔγA | Latent Image Stability ΔγB | Remarks |
|---|---|---|---|
| 14 | 106 | 123 | Comparative Example |
| 15 | 104 | 103 | Present Invention |
| 16 | 105 | 106 | Present Invention |
| 17 | 107 | 108 | Present Invention |
| 18 | 109 | 75 | Comparative Example |

As can clearly be seen from Table 7, samples of the present invention exhibited effects to enhance processing stability as well as latent image stability. Sample 15 in which the antifoggant (STAB-1) was not added during twice addition of the brominated compound exhibited better results than Sample 7. Further, Sample 15 is better than Sample 16 in which the aforesaid antifoggant was not added prior to the first addition of the brominated compound. Still further, Sample 18 in which the interval during the second addition was shorter exhibited none of the effects of the present invention. On the contrary, Sample 19 in which the interval was longer exhibited the desired results.

Example 3

Samples 1 through 19, which had been prepared in Examples 1 and 2, were subjected to scanning exposure in the following manner. Employed as light sources were a semiconductor laser (having an oscillation wavelength of 650 nm), a He—Ne gas laser (having an oscillation wavelength of 544 nm), and an Ar gas laser (having an oscillation wavelength of 458 nm). During modulation of the light amount of each laser beam employing AOM, based on image data, while employing a scanning exposure apparatus which was adjusted so that overlapping between light beam rasters was 25 percent, the resulting laser beam was reflected by a polygonal mirror and was subjected to primary scanning on a light-sensitive material. At the same time, the light-sensitive material was transported (as secondary scanning) in the vertical direction with respect to the primary scanning direction. The scanning exposure was carried out so that it was possible to reproduce stepwise grays from the maximum density to the minimum density, employing a 1 cm×1 cm patch image while adjusting the exposure amount of each color. Processing was carried out employing the aforesaid photographic processing one hour after exposure. The reflection density of each step of gray patches, prepared as above, was determined employing a densitometer PDA-65 (manufactured by Konica Corp.). Red light reflection density versus the exposure amount of the red laser beam was plotted (resulting in a characteristic curve), green light reflection density versus the exposure amount of the green laser beam was plotted, and then blue light reflection density versus the exposure amount of the blue laser beam was also plotted. Subsequently, the differential value of density with respect to the exposure amount of each step for each color image was determined and the point-gamma was obtained. Exposure range (the effective gradation range), in which the point-gamma exceeded 1.0, was determined. Further, the average gradation was simultaneously determined in which reflection density was from 0.8 to 1.8.

The following was found. Each sample of the present invention exhibits excellent processing stability as well as excellent latent image stability compared to comparative samples. Further, the effective gradation range (VE) of each of the color image forming layers is maintained from 0.65 to 0.84. Still further, it is possible to consistently reproduce at most 0.08 the difference between the VE value of the image forming layer which makes the effective gradation range (VE) maximum and the VE value of the image forming layer which makes a minimum of the same. As a result, it is possible to consistently obtain the reproduction of fine lines.

Example 4

Preparation of Silver Halide Emulsions (Preparation of Blue-Sensitive Silver Halide Emulsion)

(Preparation of Silver Halide Emulsion)

Simultaneously added to 1 liter of a 2 percent aqueous gelatin solution maintained at 40° C. were (Solution A1) and (Solution B1), described below, over 30 minutes while adjusting the pAg and the pH to 7.3 and 3.0, respectively. Subsequently, (Solutions A2) and (Solution B2), described below, were simultaneously added over 150 minutes while adjusting the pAg and the pH to 8.0 and 5.5, respectively. During such operations, the pAg was controlled employing the method described in Japanese Patent Publication Open to Public Inspection No. 59-45437, while the pH was controlled by adding an aqueous sulfuric acid or an aqueous sodium hydroxide solution.

(Solution A1)

Sodium chloride 3.42 g

Potassium bromide 0.03 g

Water to make 200 ml (Solution A2)

Sodium chloride 71.9 g $K_2IrCl_6$ $4\times10^{-8}$ mol/mol of Ag $K_4Fe(CN)_6$ $2\times10^{-5}$ mol/mol of Ag Potassium bromide 0.7 g Water to make 420 ml (Solution A3)

Sodium chloride 30.8 g

Potassium bromide 0.3 g

Water to make 180 ml (Solution B1)

Silver nitrate 10 g

Water to make 200 ml (Solution B2)

Silver nitrate 210 g

Water to make 420 ml (Solution B3)

Silver nitrate 90 g

Water to make 180 ml

After desalting was carried out employing a 5 percent Demol N (manufactured by Kao Atlas Co.) solution and a 20 percent aqueous magnesium sulfate solution, the resulting product was mixed with an aqueous gelatin solution, whereby Silver Halide Emulsion B-101, comprised of monodispersed cubic grains, was prepared which had an average grain diameter of 0.64 μm, a variation coefficient of the grain size distribution of 0.07, and a silver chloride content of 99.5 mol percent.

In Silver Halide Emulsion B-101, the portion, which has been subjected to growth employing (Solution 3A) and (solution 3B), corresponds to the shell portion. The volume ratio occupied by the shell portion was 30 percent in a silver halide grain.

Silver Halide Emulsion B-102 was prepared in the same manner as aforesaid Silver Halide Emulsion B-101, except that STAB-1 was added to both (Solution A2) and (Solution A3) in an amount of $2\times10^{-4}$ mol/mol of Ag.

Silver Halide Emulsions B-103 through B-115 were prepared in the same manner as aforesaid Silver Halide Emulsion B-102, except that the added amount of (Solution A2), (Solution A3), (Solution B2), and (Solution B3), as well as types and amounts of incorporated compounds were suitably controlled or combined as described in Table 8.

TABLE 8

| Silver Halide Emulsion No. | Volume of Shell Portion (in volume %) | Composition of Shell Portion: Compound A Type | Composition of Shell Portion: Compound A Content Amount (in mol/mol of Ag | Composition of Core Portion: Compound A Type | Composition of Core Portion: Compound A Content Amount (in mol/mol of Ag |
|---|---|---|---|---|---|
| B-101 | 30 | — | — | — | — |
| B-102 | 30 | STAB-1 | $2\times10^{-4}$ | STAB-1 | $2\times10^{-4}$ |
| B-103 | 30 | STAB-1 | $1\times10^{-4}$ | STAB-1 | $1\times10^{-4}$ |
| B-104 | 30 | STAB-1 | $2\times10^{-4}$ | STAB-1 | $1\times10^{-4}$ |
| B-105 | 30 | STAB-1 | $1.5\times10^{-4}$ | STAB-1 | $2\times10^{-4}$ |
| B-106 | 30 | STAB-1 | $1\times10^{-4}$ | STAB-1 | $1\times10^{-4}$ |
| B-107 | 30 | STAB-1 | $0.5\times10^{-4}$ | STAB-1 | $2\times10^{-4}$ |
| B-108 | 30 | — | — | STAB-1 | $2\times10^{-4}$ |
| B-109 | 30 | STAB-1 | $0.1\times x10^{-4}$ | STAB-1 | $1\times10^{-4}$ |
| B-110 | 30 | STAB-1 | $0.5\times10^{-4}$ | STAB-1 | $1\times10^{-4}$ |
| B-111 | 30 | STAB-2 | $0.5\times10^{-4}$ | STAB-1 | $1\times10^{-4}$ |
| B-112 | 30 | STAB-2 | $0.5\times10^{-4}$ | STAB-2 | $1\times10^{-4}$ |
| B-113 | 50 | STAB-1 | $0.5\times10^{-4}$ | STAB-1 | $1\times10^{-4}$ |
| B-114 | 10 | STAB-1 | $0.5\times10^{-4}$ | STAB-1 | $1\times10^{-4}$ |
| B-115 | 5 | STAB-1 | $0.5\times10^{-4}$ | STAB-1 | $1\times10^{-4}$ |

STAB-1: 1-(3-acetoamidophenyl)-5-mercaptotetrazole

STAB-2: 1-phenyl-5-mercaptotetrazole (Blue-Sensitive Silver Halide Emulsions B-201 Through B-215)

Subsequently, the compounds described below were added to the above-described Emulsion B-101 at 65° C. at an interval of one minute in the stated order. The resultant mixture was maintained at 65° C. to proceed with chemical sensitization. Ripening time was determined so as to result in the optimal relationship between fog and sensitivity. As a result, suitable time was 150 minutes after the addition of 1: sodium thiosulfates. After the elapse of the ripening time, STAB-2 was added in an amount of $5\times10^{-4}$ mol/mol of AgX and cooled whereby optimally sensitized Blue-Sensitive Silver Halide Emulsion B-201 was prepared.

| | |
|---|---|
| 1: sodium thiosulfates | $5\times10^{-6}$ mol/mol of AgX |
| 2: chloroauric acid | $1.5\times10^{-5}$ mol/mol of AgX |
| 3: STAB-1 | $3\times10^{-4}$ mol/mol of AgX |
| 4: Sensitizing dye (BS-1) | $4\times10^{-4}$ mol/mol of AgX |
| 5: Sensitizing dye (BS-2) | $1\times10^{-4}$ mol/mol of AgX |

Subsequently Blue-Sensitive Silver Halide Emulsions B-202 through B-215 were prepared in the same manner as aforesaid Blue-Sensitive Silver Halide Emulsion B-201, except that Silver Halide Emulsion B-101 was successively replaced with each of Silver Halide Emulsions B-102 through B-115 and ripening time of each emulsion was varied so as to result in the optimal relationship between fog and sensitivity.

(Preparation of Green-Sensitive Silver Halide Emulsions)

(Preparation of Silver Halide Emulsion)

In the same manner as preparation of aforesaid Silver Halide Emulsion B-101, monodispersed cubic Silver Halide Emulsion G-101 was prepared which had an average grain diameter of 0.40 $\mu$m, a variation coefficient of grain size distribution of 0.08, and a silver chloride content of 99.5 mol percent, except that the addition time of (Solution A1), (Solution B1), (Solution A2), (Solution A3), and (Solution B3) was suitably varied.

Further, in the same manner as preparation of aforesaid Silver Halide Emulsions B-102 through B-115, Silver Halide Emulsions G-102 through G-115 were prepared so as to result in the compositions similar to those in Table 8 by suitably regulating the type and amount of each of incorporated compounds or combining those.

(Green-Sensitive Silver Halide Emulsions G-201 Through G-215)

The compounds described below were added to each of Silver Halide Emulsions G-101 through G-115 prepared as above at 65° C. at an interval of one minute in the stated order. The resultant mixture was maintained at 65° C. to proceed with chemical sensitization. Ripening time was determined for each emulsion so as to result in the optimal relationship between fog and sensitivity. After the elapse of the ripening time, STAB-2 was added in an amount of $8\times10^{-4}$ mol/mol of AgX and then cooled whereby optimally sensitized Green-Sensitive Silver Halide Emulsions G-201 through G-215 were prepared.

| | |
|---|---|
| 1: Sensitizing dye (GS-1) | $4\times10^{-4}$ mol/mol of AgX |
| 2: Chloroauric acid | $1.5\times10^{-4}$ mol/mol of AgX |
| 3: STAB-1 | $1.2\times10^{-4}$ mol/mol of AgX |
| 4: Sodium thiosulfate | 30 mol percent with respect to |

(Red-Sensitive Silver Halide Emulsions R-201 Through R-215)

The compounds described below were added at 65° C. to each of Silver Halide Emulsions G-101 through G-115 prepared as above at an interval of one minute in the stated order. The resultant mixture was maintained at 65° C. to proceed with chemical sensitization. Ripening time was determined for each emulsion so as to result in the optimal relationship between fog and sensitivity. After the elapse of the ripening time, STAB-2 was added in an amount of $8\times10^{-4}$ mol/mol of AgX and cooled whereby optimally sensitized Red-Sensitive Silver Halide Emulsions R-201 through R-215 was prepared.

| | |
|---|---|
| 1: Sodium thiosulfate | $1.2\times1^{-5}$ mol/mol of AgX |
| 2: chloroauric acid | $1.5\times10^{-5}$ mol/mol of AgX |
| 3: STAB-1 | $1.2\times10^{-4}$ mol/mol of AgX |
| 4: Sensitizing dye (RS-1) | $1\times10^{-4}$ mol/mol of AgX |
| 5: Sensitizing dye (RS-2) | $1\times10^{-4}$ mol/mol of AgX |

Further, when the red-sensitive silver halide emulsions were prepared, SS-1 was added in an amount of $2.0\times10^{-3}$ g per mol of silver halide.

BS-1

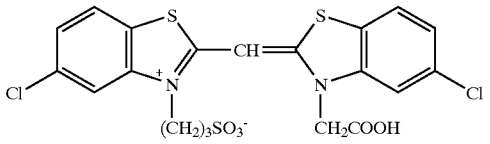

BS-2

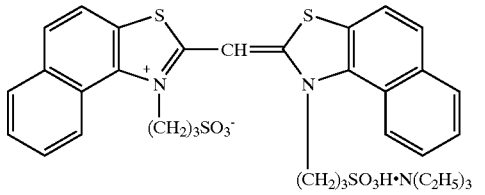

GS-1

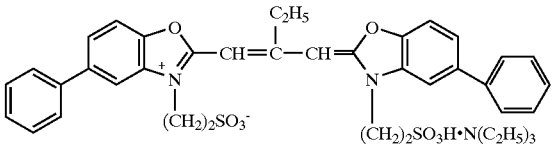

RS-1

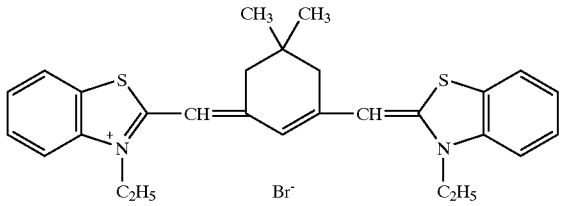

RS-2

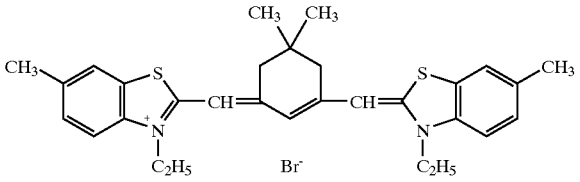

SS-1

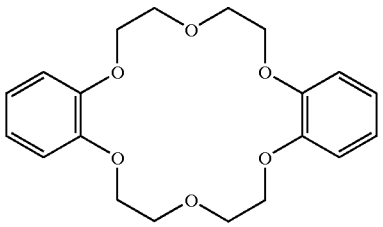

Preparation of Silver Halide Light-Sensitive Color Photographic Materials (Preparation of Sample 101)

An emulsion layer coating surface of paper pulp, having a basis weight of 180 g/m$^2$, was laminated with fused high density polyethylene comprising dispersed surface-treated anatase type titanium oxide in an amount of 15 percent by weight, while the opposite surface was laminated with high density polyethylene. The resulting reflection support was subjected to a corona discharge treatment, and was then provided with a gelatin sublayer. Further, the resulting support was coated with each of the photographic constitution layers comprised of materials described in Tables 9 and 10, whereby Sample 101 was prepared which was the silver halide light-sensitive color photographic material.

Incidentally, added as a hardener were (H-1) and (H-2) to the second layer, the fourth layer and the seventh layer. Further, added as a coating aid to control the surface tension were surface active agents (SU-2) and (SU-3) to each layer. Still further, added was antifungal agent (F-1) to each layer so that the total amount reached 0.4 g/m$^2$. Incidentally, the amount of the silver halide emulsion in the tables was represented in terms of silver.

TABLE 9

| Layer | Composition | Added amount (in g/m$^2$) |
|---|---|---|
| Seventh Layer (Protective Layer) | Gelatin | 0.70 |
| | DIDP | 0.002 |
| | DBP | 0.002 |
| | carbon dioxide | 0.003 |
| Sixth Layer (UV Absorbing Layer) | Gelatin | 0.40 |
| | AI-1 | 0.01 |
| | UV Absorber (UV-1) | 0.07 |
| | UV Absorber (UV-2) | 0.12 |
| | Antistaining Agent (HQ-5) | 0.02 |
| Fifth Layer (Red-Sensitive Layer | gelatin | 1.00 |
| | Red-Sensitive Silver chlorobromide Emulsion (R-201) | 0.17 |
| | Cyan Coupler (C-1) | 0.22 |
| | Cyan Coupler (C-2) | 0.06 |
| | Dye Image Stabilizer (ST-1) | 0.06 |
| | Antistaining Agent (HQ-1) | 0.003 |
| | DBP | 0.10 |
| | DOP | 0.20 |
| Fourth Layer (UV Absorbing Layer) | gelatin | 0.94 |
| | AI-1 | 0.02 |
| | UV Absorber (UV-1) | 0.17 |
| | UV Absorber (UV-2) | 0.27 |
| | Antistaining Agent (HQ-5) | 0.06 |

TABLE 10

| Layer | Composition | Added amount (in g/m$^2$) |
|---|---|---|
| Third Layer (Green-Sensitive Layer) | gelatin | 1.30 |
| | AI-2 | 0.01 |
| | Green-Sensitive Silver Chlorobromide Emulsion (G-201) | 0.12 |
| | Magenta Coupler (M-1) | 0.05 |
| | Magenta Coupler (M-2) | 0.15 |
| | Dye Image Stabilizer (ST-3) | 0.10 |
| | Dye Image Stabilizer (ST-4) | 0.02 |
| | DIDP | 0.10 |
| | DBP | 0.10 |
| Second Layer (Interlayer) | gelatin | 1.20 |
| | AI-3 | 0.01 |
| | Antistaining Agent (HQ-1) | 0.02 |
| | Antistaining Agent (HQ-2) | 0.03 |
| | Antistaining Agent (HQ-3) | 0.06 |
| | Antistaining Agent (HQ-4) | 0.03 |
| | Antistaining Agent (HQ-5) | 0.03 |
| | DIDP | 0.04 |
| | DBP | 0.02 |

TABLE 10-continued

| Layer | Composition | Added amount (in g/m$^2$) |
|---|---|---|
| First Layer (Blue-Sensitive Layer) | Gelatin | 1.10 |
| | Blue-Sensitive Silver Chlorobrimide Emulsion (B-201) | 0.24 |
| | Yellow Coupler (Y-1) | 0.10 |
| | Yellow Coupler (Y-2) | 0.30 |
| | Yellow Coupler (Y-3) | 0.05 |
| | Dye Image Stabilizer (ST-1) | 0.05 |
| | Dye Image Stabilizer (ST-2) | 0.05 |
| | Dye Image Stabilizer (ST-5) | 0.10 |
| | Antistaining Agent (HQ-1) | 0.005 |
| | Image Stabilizer A | 0.08 |
| | Image Stabilizer B | 0.04 |
| | DNP | 0.05 |
| | DBP | 0.15 |
| Support | polyethylene laminated paper (containing a minute amount of colorants) | |

Each additive employed to prepare Sample 101 will now be detailed.

SU-2: sodium di(2-ethylhexyl)sulfosuccinate

SU-3: sodium 2,2,3,3,4,4,5,5-octafluoropentylsufosuccinate

DBP: dibutyl phthalate

DNP: dinonyl phthalate

DOP: dioctyl phthalate

DIDP: di-i-decyl phthalate

H-1: tetrakis(vinylsulfonylmethyl)methane

H-2: sodium 2,4-dichloro-6-hydroxy-s-triazine

HQ-1: 2,5-di-t-octylhydroquinone

HQ-2: 2,5-di-sec-dodecylhydroquinone

HQ-3: 2,5-di-sec-tetradecylhydroquinone

HQ-4: 2-sec-dodecyl-5-sec-tatradecylhydroquinone

HQ-5: 2,5-di[(1,1-dimethyl-4-hexyloxycarbonyl)butyl] hydroquinone

Image Stabilizer A: P-t-octylphenol

Image Stabilizer B: poly(t-butylacrylamide)

Y-1

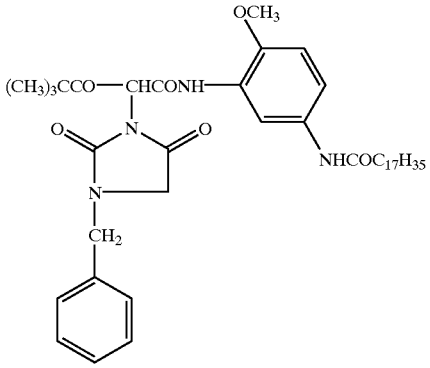

Y-2

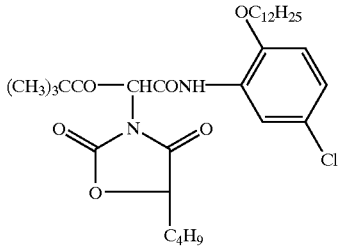

Y-3

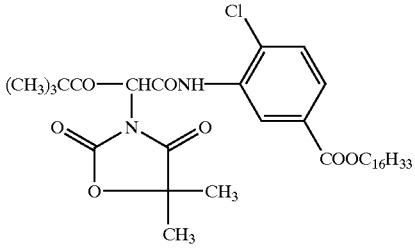

M-1

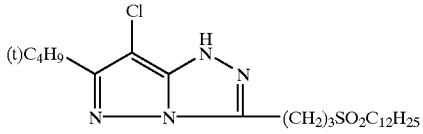

M-2

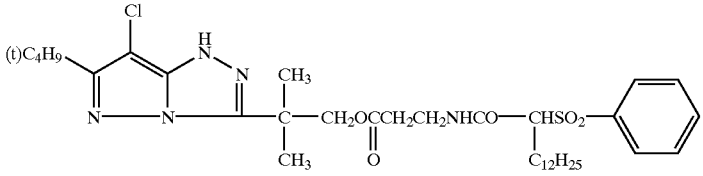

-continued
C-1
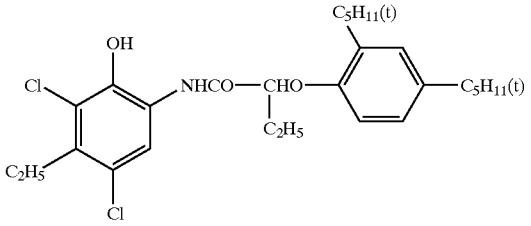
C-2
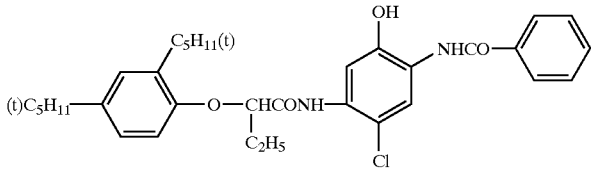
ST-1
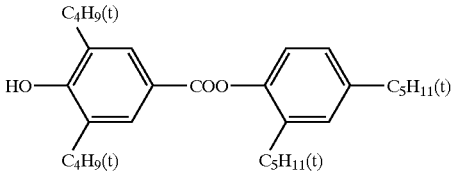
ST-2
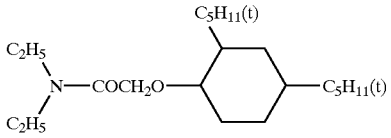
ST-3
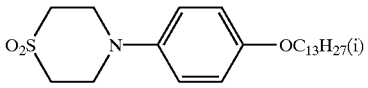
ST-4
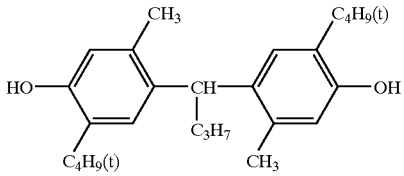
ST-5
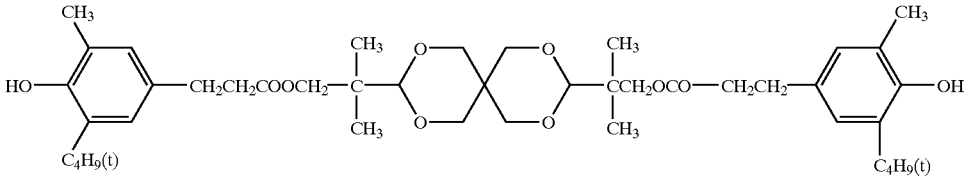
Al-1
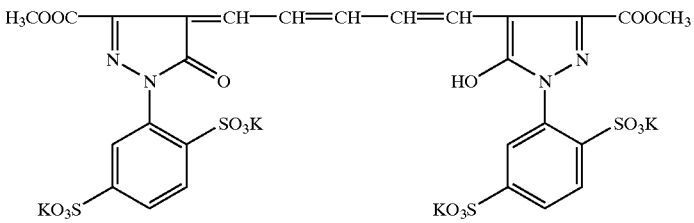
Al-2
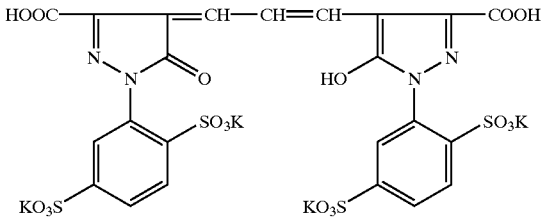
Al-3
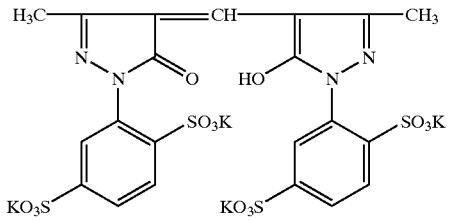
F-1
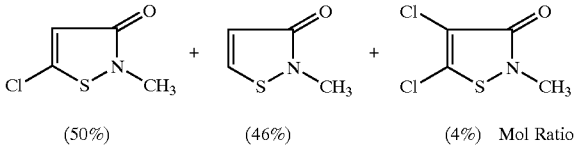
(50%) (46%) (4%) Mol Ratio
Mixture having a mol ratio of 50:46:4
UV-1
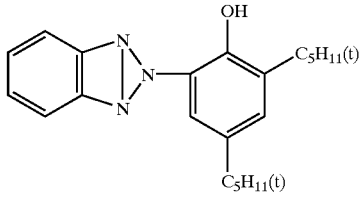

-continued

UV-2

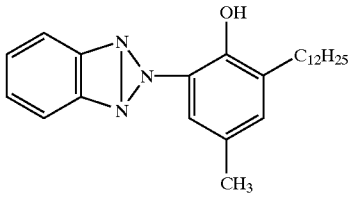

(Preparation of Sample 102 Through 115)

Each of Samples 102 through 115 was prepared in the same manner as aforesaid Sample 101, except that Blue-Sensitive Silver Halide Emulsion B-201 was successively replaced with each of B-202 through B-215, Green-Sensitive Silver Halide Emulsion G-201 was successively replace with each of G-202 through G-215, and Red-Sensitive Silver Halide Emulsion R-201 was successively replaced with each of R-202 through R-215.

Evaluation of Silver Halide Light-Sensitive Color Photographic Materials

Samples 101 through 115, prepared as above, were subjected to evaluation of sensitivity, fog, latent image stability, and pressure resistance, employing the methods described below.

(Evaluation 1: Evaluation of Sensitivity and Fog at High Intensity Exposure as well as Evaluation of Latent Image Stability After Exposure)

Each sample was subjected to wedge exposure for $10^{-6}$ second, employing a high intensity xenon flash exposure sensitometer (Type SX-20, manufactured by Yamashita Denso Co., Ltd.). The exposed sample was set aside 5 minutes after exposure, and subsequently was subjected to color photographic processing, employing the processing steps described below. This procedure was termed Process A. On the other hand, an exposed sample, employing the aforesaid method, was set aside 5 seconds after exposure and was subjected to color photographic processing in the same manner as above. This procedures was termed Process B.

The reflection density of the yellow image of each sample, which had been subjected to photographic processing as above, was determined employing an optical densitometer (Type PDA-65, manufactured by Konica Corp.). Subsequently, the characteristic curve of the yellow image was prepared in which the ordinate represented the reflection density (D) and the abscissa represented the exposure amount (LogE). Each characteristic value was determined as described below.

Sensitivity of each sample, which had been subjected to Process A, was determined employing Formula 5 described below. The sensitivity, as described herein, is relative sensitivity when the sensitivity of Sample 102, which had been subjected to Process A, was 100. Further, the minimal density value in each characteristic curve was described as fog density.

Subsequently, ($\gamma a$) which was gradation $\gamma$ obtained employing Process A, as well as ($\gamma b$), which was gradation $\gamma$ obtained employing Process B, was determined based on Formula 6, described below. Thereafter, variation value $\Delta\gamma$ was calculated based on Formula 7 described below, employing each gradation value $\gamma$. Incidentally, as value $\Delta\gamma$ approaches 100, latent image stability is more enhanced.

Sensitivity=1/(exposure amount to result in density of fog plus 1.0) Formula 5

Gradation $\gamma$=1/[Log(exposure amount to result in density of fog plus 0.1)−Log(exposure amount to result in density of fog plus 0.4)] Formula 6

$\Delta\gamma=(\gamma b/\gamma a)\times 100$ Formula 7

(Evaluation 2: Evaluation of Pressure Resistance of Light-sensitive Materials)

Each sample was subjected to wedge exposure for $10^{-6}$ second employing blue light produced using a blue filter, and a high intensity xenon flash sensitometer (Type SX-20, manufactured by Yamashita Denso Co., Ltd.). After exposure, each sample was immersed in 38° C. water for 45 seconds. Subsequently, pressure was applied to the resulting sample, based on the pressure applying method described below, and was then subjected to color photographic processing based on the processing steps, also described below.

<Pressure Applying Method>

A sample was fixed on a horizontal plane and was then subjected to vertical pressure application with respect to the steps of the exposure wedge, while moving at a constant rate a needle which was subjected to load application. During the operation, employed as the needle was a sapphire needle having a contact portion of 0.3 mm. The needle was scanned at a rate of 1 cm/second and applied load was successively varied from 10 to 100 g.

Each sample, which had been subjected to photographic processing described as above, was visually inspected. The pressure resistance of each sample was evaluated based on the relationship between the density variation of exposed and unexposed areas due to pressure application and applied load. Incidentally, each sample was evaluated under 5 ranks, A through E. "A" was given to an excellent sample in which no density variation due to pressure application was noted, and "E" was given to the lowest pressure resistant sample in which density variation due to pressure application occurred from the low load. The range between A and E was equally divided and ranks B, C, and D were given.

(Color Photographic Processing)

| Processing Step | Processing Temperature | Time | Replenishment Rate |
|---|---|---|---|
| Color Development | 38.0 ± 0.3° C. | 45 seconds | 80 ml |
| Bleach-Fixing | 35.0 ± 0.5° C. | 45 seconds | 120 ml |
| Stabilization | 30–34° C. | 60 seconds | 150 ml |
| Drying | 60–80° C. | 30 seconds | |

(Compositions of Each Processing Solution of Color Photographic Processing)

<Color Developer Tank Solution and its Replenisher)

| | Tank Solution | Replenisher |
|---|---|---|
| Pure water | 800 ml | 800 ml |
| Triethylenediamine | 2 g | 3 g |
| Diethylene glycol | 10 g | 10 g |
| Potassium bromide | 0.01 g | — |
| Potassium chloride | 3.5 g | — |
| Potassium sulfite | 0.25 g | 0.5 g |
| N-ethyl-N-(βmethanesulfonamidoethyl)-3-methyl-4-aminoaniline sulfate | 6.0 g | 10.0 g |
| N,N-diethylhydroxylamine | 6.8 g | 6.0 g |
| Triethanolamine | 10.0 g | 10.0 g |
| Sodium diethylenetriamoinepentaacetate | 2.0 g | 2.0 g |
| Optical brightening agent (4,4'-diamonostilbenedisulfonic acid derivative) | 2.0 g | 2.5 g |
| Potassium carbonate | 30 g | 30 g |

Each total volume was adjusted to 1 liter by adding water. The pH of the tank solution and the replenisher was adjusted to 10.10 and 10.60, respectively.

<Bleach-Fixer Tank Solution and its Replenisher>

Diethylenetriaminepentaacetatoiron(II) ammonium dihydrate salt 65 g

Diethylenetriaminepentaacetic acid 3 g

Ammonium thiosulfates (70 percent aqueous solution 100 ml

2-Amino-5-mercapto-1,3,4-thaidiazole 2.0 g

Ammonium sulfite (40 percent aqueous solution) 27.5 ml

Water to make 1 liter

The pH was adjusted to 5.0 by adding potassium carbonate or glacial acetic acid.

<Stabilizer Tank Solution and its Replenisher> o-Phenylphenol 1.0 g

5-Chloro-2-methyl-4-isothiazoline-3-one 0.02 g

2-Methyl-4-isothiazoline-3-one 0.02 g

Diethylene glycol 1.0 g

Optical brightening agent (Cinopal SFP) 2.0 g 1-hydoxyethylidene-1,1-disulfonic acid 1.8 g Bismuth chloride (45 percent aqueous solution) 0.65 g Magnesium sulfate heptahydrate 0.2 g PVP (polyvinylpyrrolidone) 1.0 g Aqueous ammonia (25 percent aqueous ammonium hydroxide) 2.5 g Trisodium nitrilotriacetate 1.5 g Water to make 1 liter The pH was adjusted to 7.5 by adding sulfuric acid or aqueous ammonia.

Table 11 shows the obtained results.

TABLE 11

| | Each Spectrally Sensitized Silver Halide Emulsion | | | Latent Image | | | | |
|---|---|---|---|---|---|---|---|---|
| Sample No. | First Layer | Third Layer | Fifth Layer | Sensitivity | Fog Density | Stability Δγ | Pressure Resistance | Remarks |
| 101 | B-201 | G-201 | R-201 | 100 | 0.045 | 128 | C | Comp. |
| 102 | B-202 | G-202 | R-202 | 90 | 0.023 | 122 | E | Comp. |
| 103 | B-203 | G-203 | R-203 | 92 | 0.034 | 119 | D | Comp. |
| 104 | B-204 | G-204 | R-204 | 95 | 0.025 | 123 | E | Comp. |
| 105 | B-205 | G-205 | R-205 | 113 | 0.014 | 111 | B | Inv. |
| 106 | B-206 | G-206 | R-206 | 119 | 0.018 | 109 | A | Inv. |
| 107 | B-207 | G-207 | R-207 | 122 | 0.025 | 112 | A | Inv. |
| 108 | B-208 | G-208 | R-208 | 128 | 0.028 | 110 | A | Inv. |
| 109 | B-209 | G-209 | R-209 | 135 | 0.021 | 107 | A | Inv. |
| 110 | B-210 | G-210 | R-210 | 133 | 0.015 | 105 | A | Inv. |
| 111 | B-211 | G-211 | R-211 | 130 | 0.015 | 106 | A | Inv. |
| 112 | B-212 | G-212 | R-212 | 128 | 0.013 | 106 | A | Inv. |
| 113 | B-213 | G-213 | R-213 | 115 | 0.017 | 108 | A | Inv. |
| 114 | B-214 | G-214 | R-214 | 132 | 0.019 | 102 | A | Inv. |
| 115 | B-215 | G-215 | R-215 | 135 | 0.022 | 99 | A | Inv. |

Comp.: Comparative Example
Inv.: Present Invention

STAB-1, as a compound corresponding to Compound A was added to each of Samples 102 through 110. In Samples 102 and 103, the concentration of STAB-1 incorporated in the shell portion and the core portion specified in the present invention was the same. As a result, it can clearly be seen that the effects of the present invention were not obtained and particularly, pressure resistance resulted in problems. Sample 104, in which the concentration of STAB-1 in the core portion was greater than that in shell portion, exhibited the same results. On the other hand, it was found that Sample 105, in which the concentration of STAB-1 in the core portion specified in the present invention was less than that in the shell portion, resulted in enhanced pressure resistance, as well as exhibited higher sensitivity and lower fog.

As long as this composition was assured, Samples 105 though 115 showed that the effects of the present invention was obtained. Of these, when the concentration of STAB-1 in the shell portion was less than $1.5\times10^{-4}$, or in more detail, when the same is from $0.1\times10^{-4}$ to $0.5\times10^{-4}$ it was possible to confirm that enhanced effects were greater based on Samples 109 and 110.

Further, as shown by Samples 111 and 112, it was possible to confirm that the analogous improvement effects were obtained by combining STAB-1 with STAB-2 which was in the category of Compound A, or replacing STAB-1 with STAB-2.

Further, when the volume ratio of the shell portion in the total volume of silver halide grains was at most 30 percent, the effects of the present invention were enhanced. Based on the results of Samples 113 through 115, it is possible to deduce that silver halide emulsions having an extremely thin shell portion near the surface of a grain, such that the volume ratio of shell portion is 5 or 10 percent, are preferred due to greater enhancement of latent image stability.

As can clearly be seen from Table 11, each sample which employed the silver halide emulsion, prepared employing the method specified in the present invention, and had the Composition specified in the present invention, exhibited higher sensitivity and lower fog, at high intensity exposure, resulted excellent latent image stability, and resulted in no problems of pressure resistance.

Incidentally, in aforesaid Evaluation 1, the magenta images as well as cyan images were subjected to evaluation of sensitivity at high intensity exposure, fog, and latent image stability in the same manner as above. Further, in Evaluation 2, filters employed during wedge exposure were varied to a green filter and a red filter, and the resulting magenta images, as well as cyan images, were subjected to evaluation of pressure resistance in the same manner as above.

As a result, it was possible to confirm that when the constitution of the present invention was satisfied, the green-sensitive emulsions, as well as red-sensitive emulsions exhibited improved results in the same manner as the blue-sensitive emulsions.

Example 5

Preparation of Silver Halide Emulsions (Preparation of Blue-Sensitive Silver Halide Emulsions B-301 Through B-315)

Blue-Sensitive Silver Halide Emulsion B-301 was prepared in the same manner as Blue-Sensitive Silver Halide Emulsion B-201 described in Example 1, except that BB-4, which corresponded to Compound B, was added 150 minutes after addition of sodium thiosulfate in an amount of $0.5\times10^{-6}$ mol/mol of AgX; STAB-2 was then added 20 minutes after the aforesaid addition in an amount of $5\times10^{-4}$ mol/mol of AgX; and the resulting mixture was cooled.

Blue-Sensitive Silver Halide Emulsions B-302 through B-313 were prepared in the same manner as Blue-Sensitive Silver Halide Emulsion B-301, except that the types of added Compound B, the time from the addition of sodium thiosulfate to each addition of Compound B, and the addition interval from the addition of Compound B to the addition of STAB-2 were varied as described in Table 12.

Incidentally, when Blue-Sensitive Silver Halide Emulsion B-310 was prepared, Compound BB-15 and STAB-2 were added simultaneously. Further, Blue-Sensitive Silver Halide Emulsion B-311 was prepared in such a manner that both compounds were added under the conditions which were reversed from those specified in the present invention, that is, STAB-2was added 140 minutes after the addition of sodium thiosulfate and Compound BB-15 was added 10 minutes after the aforesaid addition.

Blue-Sensitive Silver Halide Emulsions B-314 and B-315 were prepared in the same manner as Silver Halide Emulsion B-305, except that Silver Halide Emulsion B-101 was replaced with B-110 and B-114.

TABLE 12

| | Each Spectrally Sensitized Silver Halide Emulsion No. | | | | | |
|---|---|---|---|---|---|---|
| Silver Halide Emulsion No. | Blue-Sensitive Silver Halide Emulsion | Green-Sensitive Silver Halide Emulsion | Red-Sensitive Silver Halide Emulsion | Type of Compound B | *1 (in minutes) | *2 (in minutes) |
| B-101 | B-201 | G-201 | R-201 | — | 150 | — |
| B-101 | B-301 | G-301 | R-301 | BB-4 | 150 | 20 |
| B-101 | B-302 | G-302 | R-302 | BB-8 | 150 | 20 |
| B-101 | B-303 | G-303 | R-303 | BB-9 | 150 | 20 |
| B-101 | B-304 | G-304 | R-304 | BB-11 | 150 | 20 |
| B-101 | B-305 | G-305 | R-305 | BB-15 | 150 | 20 |
| B-101 | B-306 | G-306 | R-306 | BB-15 | 150 | 30 |
| B-101 | B-307 | G-307 | R-307 | BB-15 | 150 | 40 |
| B-101 | B-308 | G-308 | R-308 | BB-15 | 150 | 10 |
| B-101 | B-309 | G-309 | R-309 | BB-15 | 150 | 5 |
| B-101 | B-310 | G-310 | R-310 | BB-15 | 150 | 0 (simultaneous addition) |
| B-101 | B-311 | G-311 | R-311 | BB-15 | 150 | −10 (pre-addition of STSB-2) |
| B-101 | B-312 | G-312 | R-312 | BB-15 | 90 | 20 |
| B-101 | B-313 | G-313 | R-313 | BB-15 | 150 | 20 |
| B-110 | B-314 | G-314 | R-314 | BB-15 | 150 | 20 |
| B-114 | B-315 | G-315 | R-315 | BB-15 | 150 | 20 |

*1: time from the addition of sodium thiosulfate to the addition of Compound B

*2: time from the addition of Compound B to the addition of STAB-2

(Preparation of Green-Sensitive Silver Halide Emulsions G-301 Through G-315)

Green-Sensitive Silver Halide Emulsions G-301 through G-315 were prepared in the same manner as Green-Sensitive Silver Halide Emulsion G-201 described in Example 4 under the same conditions and combinations employed to prepare aforesaid Blue-Sensitive Silver Halide Emulsions B-301 through B-315, except that the types of added Compound B, the time from the addition of sodium thiosulfate to each addition of Compound B, and the addition interval from the addition of Compound B to the addition of STAB-2 were varied as described in Table 12.

(Preparation of Red-Sensitive Silver Halide Emulsions R-301 Through R-315)

Red-Sensitive Silver Halide Emulsions R-301 through R-315 were prepared in the same manner as Red-Sensitive Silver Halide Emulsion R-201 described in Example 4 under the same conditions and combinations employed to prepare aforesaid Blue-Sensitive Silver Halide Emulsions B-301 through B-315, except that the types of added Compound B, the time from the addition of sodium thiosulfate to each addition of Compound B, and the addition interval from the addition of Compound B to the addition of STAB-2 were varied as described in Table 12. Incidentally, Red-Sensitive Silver Halide Emulsions R-314and R-315 were prepared in the same manner as Red-Sensitive Silver Halide Emulsion R-305, except that Silver Halide Emulsion G-101 was replaced with G-110 and G-114.

Preparation of Silver Halide Light-Sensitive Color Photographic Materials

Based on the methods described in Example 4, the sensitivity, fog, latent image stability after exposure, and pressure resistance of blue-sensitive emulsions at high intensity exposure were evaluated. Table 13 shows the obtained results.

Based on the methods described in Example 4, blue-sensitive silver halide emulsions were subjected to evaluation of sensitivity during high intensity, fog, and latent image stability as well as pressure resistance after exposure. Table 13 shows the results.

In Example 5, the polychalcogen compound exemplified above was employed as a compound corresponding to Compound B, and STAB was employed as Mercapto Compound C. In Samples 201 through 205, the polychalcogen compound was added, and after 20 minutes, STAB-2 was added. All the polychalcogen compounds, which were added, were those which corresponded to Compound B exemplified above. It was found that improved effects were obtained by satisfying constitution elements of the present invention. All the compounds, which corresponded to Compound B, resulted in improved effects. Specifically, disulfide and polysulfide compounds resulted in marked effects. Of these, the most preferable compound, which resulted in high sensitivity, was sulfur (BB-15) as a simple substance.

Further, Samples 205 through 211 exhibited the effects of the addition order of Compound B and Compound C as well as the addition time, which were the constitutional elements of the present invention. When Compound B was added prior to the addition of Compound C (herein, STSB-2), the desired effects of the present invention were obtained. Further, the interval between the addition of Compound B and the addition of Compound C was preferably within 30 minutes. Samples 205 through 209 clearly showed that when the interval was 10 minutes, as well as 20 minutes, marked effects were obtained. On the other hand, it is clearly seen that no effects were obtained in Sample 210 in which both compounds were simultaneously added, as well as in Sample 211 in which STAB-2 was added 10 minutes prior to the addition of Compound B.

On the other hand, based on evaluation results of Samples 205, 212, and 213, it was found that when Compound B was added 120 minutes after the addition of chemical sensitizers (herein, sodium thiosulfate), the desired high sensitivity as well as the desired latent image stability was obtained. Further, based on the results of Samples 214 and 215, it was proved that when the present invention was put into practice while being combined with Silver Halide Emulsions B-110 and B-114, which satisfied the conditions specified in the present invention, still further desired effects were obtained.

Further, magenta images as well as cyan images were subjected to the aforesaid evaluation in the same manner as above. As a result, it was confirmed that green-sensitive

TABLE 13

| | Each Spectrally Sensitized Silver Halide Emulsion | | | | | Latent Image | | |
|---|---|---|---|---|---|---|---|---|
| Sample No. | First Layer | Third Layer | Fifth Layer | Sensitivity | Fog Density | Stability Δγ | Pressure Resistance | Remarks |
| 101 | B-201 | G-201 | R-201 | 100 | 0.045 | 128 | C | Comp. |
| 201 | B-301 | G-301 | R-301 | 109 | 0.022 | 113 | B | Inv. |
| 202 | B-302 | G-302 | R-302 | 115 | 0.020 | 109 | B | Inv. |
| 203 | B-303 | G-303 | R-303 | 117 | 0.014 | 111 | B | Inv. |
| 204 | B-304 | G-304 | R-304 | 121 | 0.018 | 105 | A | Inv. |
| 205 | B-305 | G-305 | R-305 | 137 | 0.014 | 103 | A | Inv. |
| 206 | B-306 | G-306 | R-306 | 130 | 0.017 | 106 | A | Inv. |
| 207 | B-307 | G-307 | R-307 | 127 | 0.021 | 111 | A | Inv. |
| 208 | B-308 | G-308 | R-308 | 134 | 0.015 | 102 | A | Inv. |
| 209 | B-309 | G-309 | R-309 | 132 | 0.015 | 106 | A | Inv. |
| 210 | B-310 | G-310 | R-310 | 102 | 0.032 | 127 | C | Comp. |
| 211 | B-311 | G-311 | R-311 | 99 | 0.041 | 129 | C | Comp. |
| 212 | B-312 | G-312 | R-312 | 126 | 0.013 | 105 | A | Inv. |
| 213 | B-313 | G-313 | R-313 | 139 | 0.017 | 103 | A | Inv. |
| 214 | B-314 | G-314 | R-314 | 144 | 0.014 | 100 | A | Inv. |
| 215 | B-315 | G-315 | R-315 | 143 | 0.015 | 101 | A | Inv. |

Comp.: Comparative Example
Inv.: Present Invention emulsions as well as red-sensitive emulsions resulted in the same improvement as the blue-sensitive emulsions.

Example 6

Simples 101 through 115 and 201 through 215, prepared in aforesaid Examples 4 and 5, were exposed as follows. Employed as light sources were a semiconductor laser (having an oscillation wavelength of 650 nm), a He—Ne gas laser (having an oscillation wavelength of 544 nm), and an Ar gas laser (having an oscillation wavelength of 458 nm). During modulation of the light amount of each laser beam employing AOM, based on image data, while employing a scanning exposure apparatus which was adjusted so that overlapping between light beam rasters was 25 percent, the resulting laser beam was reflected by a polygonal mirror and was subjected to primary scanning on a light-sensitive material. At the same time, the light-sensitive material was transported (as secondary scanning) in the vertical direction with respect to the primary scanning direction. The scanning exposure was carried out so that it was possible to reproduce stepwise grays from the maximum density to the minimum density, employing a 1 cm×1 cm patch image while adjusting the exposure amount of each color. Processing was carried out employing the aforesaid photographic processing one hour after exposure. The reflection density of each step of gray patches, prepared as above, was determined employing a densitometer PDA-65 (manufactured by Konica Corp.). Red light reflection density versus the exposure amount of the red laser beam was plotted (resulting in a characteristic curve), green light reflection density versus the exposure amount of the green laser beam was plotted, and then blue light reflection density versus the exposure amount of the blue laser beam was also plotted. Subsequently, the differential value of density with respect to the exposure amount of each step for each color image was determined and the point-gamma was obtained. Exposure range (the effective gradation range), in which the point-gamma exceeded 1.0, was determined. Further, the average gradation was simultaneously determined in which reflection density was from 0.8 to 1.8.

Samples which satisfied the constitution of the present invention exhibited excellent latent image stability as well as excellent pressure resistance, compared to comparative samples. In addition, the effective gradation range (VE) in each color image forming layer was from 0.65 to 0.84 without any exception. It was also possible to consistently reproduce difference (ΔVE) between the VE value of the color image forming layer in which the effective gradation range (VE) was maximized and the VE value of the color image forming layer in which the same was minimized to be from 0 to 0.08. As a result, it was found that the reproduction of fine lines was consistently achieved. Samples 214 and 215 particularly exhibited the best results.

EFFECTS OF THE PRESENT INVENTION

The present invention makes it possible to provide a silver halide emulsion, which exhibit excellent development stability at high intensity exposure and excellent latent image stability at high intensity exposure, as well as excellent fine line reproduction, further, a silver halide emulsion, which results in high sensitivity and low fog at high intensity exposure, exhibits excellent latent image stability during the period of time from exposure to photographic processing, as well as excellent pressure resistance, a production method thereof, a silver halide light-sensitive photographic material, a silver halide light-sensitive color photographic material suitable for silver halide color paper and an image forming method using the same.

What is claimed is:

1. A silver halide emulsion comprising silver halide grains containing Compound A having adsorptivity to silver, wherein each of the silver halide grains has a silver chloride content of not less than 90% and has a core-shell structure comprised of a core and a shell having different contents of Compound A each other, and the content of Compound A in the shell is smaller than the content of Compound A in the core.

2. The silver halide emulsion of claim 1, wherein the content of Compound A of the shell is less than 1.5×10−4 moles per mole of silver halide.

3. The silver halide emulsion of claim 1, wherein Compound A has a mercapto tetrazole group.

4. The silver halide emulsion of claim 1, wherein the volume of the shell of each of the silver halide grains is not more than 50% of the whole volume of the silver halide grain.

* * * * *